US009033033B2

(12) United States Patent
Thomas et al.

(10) Patent No.: US 9,033,033 B2
(45) Date of Patent: May 19, 2015

(54) ELECTROKINETIC ENHANCED HYDROCARBON RECOVERY FROM OIL SHALE

(75) Inventors: David Glynn Thomas, San Ramon, CA (US); Marcus O. Wigand, San Ramon, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 56 days.

(21) Appl. No.: 13/335,907

(22) Filed: Dec. 22, 2011

(65) Prior Publication Data

US 2012/0273190 A1 Nov. 1, 2012

Related U.S. Application Data

(63) Continuation-in-part of application No. 13/161,885, filed on Jun. 16, 2011.

(60) Provisional application No. 61/425,517, filed on Dec. 21, 2010.

(51) Int. Cl.

| | |
|---|---|
| ***E21B 43/00*** | (2006.01) |
| ***E21B 43/16*** | (2006.01) |
| ***E21B 43/24*** | (2006.01) |

(52) U.S. Cl.

CPC ..... *E21B 43/16* (2013.01); *E21B 43/2401* (2013.01)

(58) Field of Classification Search

None

See application file for complete search history.

(56) References Cited

U.S. PATENT DOCUMENTS

| | | | |
|---|---|---|---|
| 1,269,747 | A | 6/1918 | Rogers |
| 2,969,226 | A | 1/1961 | Huntington |
| 3,001,775 | A | 9/1961 | Allred |
| 3,001,776 | A | 9/1961 | Poollen et al. |
| 3,017,168 | A | 1/1962 | Carr |
| 3,061,009 | A | 10/1962 | Shirley |

(Continued)

FOREIGN PATENT DOCUMENTS

| | | | |
|---|---|---|---|
| CA | 2668784 | * | 12/2009 |
| EP | 2372081 A1 | * | 10/2011 |

(Continued)

OTHER PUBLICATIONS

Reynolds, D.A. et al., "Electrokinetic Migration of Permanganate through Low-Permeability Media," by Ground Water, Jul.-Aug. 2008, 46(4), pp. 629-637.

(Continued)

*Primary Examiner* — Angela M DiTrani
*Assistant Examiner* — Anuradha Ahuja

(57) ABSTRACT

Disclosed herein are methods for extracting a kerogen-based product from subsurface (oil) shale formations. These methods rely on chemically modifying the shale-bound kerogen using a chemical oxidant so as to render it mobile. The oxidant is provided to a formation fluid in contact with the kerogen in the subsurface shale utilizing electrokinetic-induced migration. An electric field is generated through at least a portion of the kerogen rich zone to induce electrokinetic migration of the oxidant. A mobile kerogen-based product, that includes reaction products of kerogen conversion, is urged toward a production well utilizing electrokinetic-induced migration, and withdrawn from the subsurface shale formation. An electric field generated through at least a portion of the kerogen rich zone can also be utilized to induce migration of catalysts or catalyst precursors.

34 Claims, 6 Drawing Sheets

(56) References Cited

U.S. PATENT DOCUMENTS 3,076,762 A 2/1963 Dill
3,127,935 A 4/1964 Poettmann et al.
3,136,361 A 6/1964 Marx
3,137,347 A * 6/1964 Parker ..... 166/248
3,139,928 A 7/1964 Broussard
3,205,942 A 9/1965 Sandberg
3,223,158 A 12/1965 Baker
3,228,468 A 1/1966 Nichols
3,241,611 A 3/1966 Dougan
3,280,910 A 10/1966 Crider
3,285,335 A 11/1966 Reistle, Jr.
3,292,699 A 12/1966 Slusser et al.
3,322,194 A 5/1967 Strubhar
3,342,258 A 9/1967 Prats
3,342,261 A 9/1967 Bond
3,346,044 A 10/1967 Slusser
3,349,848 A 10/1967 Burgh
3,358,756 A 12/1967 Vogel
3,362,471 A 1/1968 Slusser et al.
3,382,922 A 5/1968 Needham
3,398,793 A 8/1968 Milton, Jr.
3,400,762 A 9/1968 Peacock et al.
3,434,757 A 3/1969 Prats
3,437,378 A 4/1969 Smith
3,442,789 A 5/1969 Zimmerman, Jr.
3,455,383 A 7/1969 Prats et al.
3,468,376 A 9/1969 Bramhall et al.
3,474,863 A 10/1969 Deans et al.
3,478,825 A 11/1969 Closmann
3,480,082 A 11/1969 Gilliland
3,481,398 A 12/1969 Prats
3,489,672 A 1/1970 Schuman
3,499,490 A 3/1970 Needham et al.
3,500,913 A 3/1970 Closmann et al.
3,502,372 A 3/1970 Prats
3,503,868 A 3/1970 Shields
3,504,747 A 4/1970 Fitch et al.
3,513,913 A 5/1970 Bruist
3,515,213 A 6/1970 Prats
3,521,709 A 7/1970 Needham
3,537,528 A 11/1970 O'Brien et al.
3,548,938 A 12/1970 Parker
3,554,283 A 1/1971 Abrams
3,561,532 A 2/1971 Roberts et al.
3,565,171 A 2/1971 Closmann
3,578,080 A 5/1971 Closmann
3,593,789 A 7/1971 Prats
3,593,790 A 7/1971 Herce
3,601,193 A 8/1971 Grady
3,661,423 A 5/1972 Garret
3,666,014 A 5/1972 Beard
3,700,280 A 10/1972 Papadopoulos et al.
3,766,982 A 10/1973 Justheim
3,779,601 A 12/1973 Beard
3,804,169 A 4/1974 Closmann
3,804,172 A 4/1974 Closmann et al.
3,882,941 A 5/1975 Pelofsky
3,950,029 A 4/1976 Timmins
3,994,343 A 11/1976 Cha et al.
4,005,752 A 2/1977 Cha
4,008,761 A 2/1977 Fisher et al.
4,008,762 A 2/1977 Fisher et al.
4,018,280 A 4/1977 Daviduk et al.
4,026,360 A 5/1977 Drinkard
4,027,731 A 6/1977 Smith et al.
4,027,917 A 6/1977 Bartel et al.
4,029,360 A 6/1977 French
4,036,299 A 7/1977 Cha et al.
4,061,190 A 12/1977 Bloomfield
4,065,183 A 12/1977 Hill et al.
4,067,390 A 1/1978 Camacho et al.
4,072,350 A 2/1978 Bartel et al.
4,076,312 A 2/1978 Cha et al.
4,082,145 A 4/1978 Elkington
4,082,146 A 4/1978 Compton et al.
4,083,604 A 4/1978 Bohn et al.
4,084,637 A * 4/1978 Todd ..... 166/245
4,084,640 A 4/1978 Allred
4,091,869 A 5/1978 Hoyer
4,105,072 A 8/1978 Cha
4,108,760 A 8/1978 Williams et al.
4,109,718 A 8/1978 Burton
4,126,180 A 11/1978 Cha
4,130,474 A 12/1978 Anthony
4,140,180 A 2/1979 Bridges et al.
4,144,935 A 3/1979 Bridges et al.
4,147,388 A 4/1979 French
4,147,389 A 4/1979 Bartel et al.
4,148,358 A 4/1979 Compton
4,148,359 A 4/1979 Laumbach et al.
4,151,068 A 4/1979 McCollum et al.
4,156,461 A 5/1979 Cha
4,158,467 A 6/1979 Larson et al.
4,162,808 A 7/1979 Kvapil et al.
4,166,721 A 9/1979 Cha
4,167,291 A 9/1979 Ridley
4,169,506 A 10/1979 Berry
4,176,882 A 12/1979 Studebaker et al.
4,181,177 A 1/1980 Compton
4,184,547 A 1/1980 Klass et al.
4,189,376 A 2/1980 Mitchell
4,191,251 A 3/1980 Cha
4,192,381 A 3/1980 Cha
4,192,552 A 3/1980 Cha
4,193,451 A 3/1980 Dauphine
4,202,412 A 5/1980 Ruskin
4,218,309 A 8/1980 Compton
4,227,574 A 10/1980 Cha
4,228,854 A * 10/1980 Sacuta ..... 166/248
4,239,283 A 12/1980 Ridley
4,239,284 A 12/1980 Ridley et al.
4,243,100 A 1/1981 Cha
4,246,965 A 1/1981 Cha
4,265,307 A 5/1981 Elkins
RE30,738 E 9/1981 Bridges et al.
4,324,292 A 4/1982 Jacobs et al.
4,328,863 A 5/1982 Berry
4,359,246 A 11/1982 Ricketts
4,366,986 A 1/1983 Bohn et al.
4,374,545 A 2/1983 Bullen et al.
4,376,034 A 3/1983 Wall
4,378,949 A 4/1983 Miller
4,379,591 A 4/1983 Tassoney
4,379,593 A 4/1983 Weichman
4,384,614 A 5/1983 Justheim
4,389,300 A 6/1983 Mitchell
4,396,491 A 8/1983 Stiller et al.
4,401,162 A 8/1983 Osborne
4,401,163 A 8/1983 Elkins
4,401,551 A 8/1983 Mitchell
4,408,665 A 10/1983 Dougan
4,423,907 A 1/1984 Ridley
4,424,121 A 1/1984 Choi et al.
4,425,220 A 1/1984 Kestner
4,425,967 A 1/1984 Hoekstra
4,435,016 A 3/1984 Wissenberg et al.
4,436,344 A 3/1984 Forgac et al.
4,437,519 A 3/1984 Cha et al.
4,441,985 A 4/1984 Burchfield et al.
4,444,258 A 4/1984 Kalmar
4,449,586 A 5/1984 Urban et al.
4,452,689 A 6/1984 Russum
4,454,915 A 6/1984 York et al.
4,456,065 A * 6/1984 Heim et al. ..... 166/248
4,457,365 A 7/1984 Kasevich et al.
4,457,374 A 7/1984 Hoekstra et al.
4,458,757 A 7/1984 Bock et al.
4,458,944 A 7/1984 Fernandes
4,470,459 A 9/1984 Copland
4,481,099 A 11/1984 Mitchell
4,483,398 A 11/1984 Peters et al.
4,485,869 A 12/1984 Sresty et al.
4,487,260 A 12/1984 Pittman et al.
4,491,514 A 1/1985 Siskin et al.

(56) References Cited

U.S. PATENT DOCUMENTS 4,495,056 A 1/1985 Venardos et al.
4,502,942 A 3/1985 Lee et al.
4,531,783 A 7/1985 Ricketts
4,532,991 A 8/1985 Hoekstra et al.
4,533,181 A 8/1985 Ricketts
4,552,214 A 11/1985 Forgac et al.
4,595,056 A 6/1986 Zahradnik et al.
4,637,464 A 1/1987 Forgac et al.
4,640,352 A 2/1987 Vanmeurs et al.
4,640,353 A * 2/1987 Schuh ..... 166/248
4,651,825 A * 3/1987 Wilson ..... 166/245
4,691,773 A 9/1987 Ward et al.
4,695,373 A 9/1987 Ho
4,698,149 A 10/1987 Mitchell
4,703,798 A 11/1987 Friedman
4,705,108 A 11/1987 Little et al.
4,718,439 A 1/1988 Gorra et al.
4,737,267 A 4/1988 Pao et al.
4,798,668 A 1/1989 Ho
4,856,587 A 8/1989 Nielson
4,856,589 A 8/1989 Kuhlman et al.
4,886,118 A 12/1989 Van Meurs et al.
4,888,031 A 12/1989 Martens
4,895,206 A 1/1990 Price
4,926,941 A * 5/1990 Glandt et al. ..... 166/248
5,020,596 A 6/1991 Hemsath
5,046,559 A * 9/1991 Glandt ..... 166/248
5,058,675 A 10/1991 Travis
5,060,726 A 10/1991 Glandt et al.
5,091,076 A 2/1992 So
5,193,618 A * 3/1993 Loh et al. ..... 166/270.1
5,236,039 A 8/1993 Edelstein et al.
5,255,742 A 10/1993 Mikus
5,297,626 A 3/1994 Vinegar et al.
5,338,442 A 8/1994 Siskin et al.
5,404,952 A 4/1995 Vinegar et al.
5,411,089 A 5/1995 Vinegar et al.
5,433,271 A 7/1995 Vinegar et al.
5,843,311 A 12/1998 Richter et al.
5,967,233 A * 10/1999 Riese et al. ..... 166/263
6,056,057 A 5/2000 Vinegar et al.
6,079,499 A 6/2000 Mikus et al.
6,102,122 A 8/2000 de Rouffignac
6,279,653 B1 8/2001 Wegener et al.
6,547,957 B1 4/2003 Sudhakar et al.
6,702,016 B2 3/2004 de Rouffignac et al.
6,715,549 B2 4/2004 Wellington et al.
6,719,047 B2 4/2004 Fowler et al.
6,722,431 B2 4/2004 Karanikas et al.
6,729,395 B2 5/2004 Shahin, Jr. et al.
6,769,483 B2 8/2004 de Rouffignac et al.
6,769,486 B2 8/2004 Lim et al.
6,782,947 B2 8/2004 de Rouffignac et al.
6,877,555 B2 4/2005 Karanikas et al.
6,880,633 B2 4/2005 Wellington et al.
6,889,769 B2 5/2005 Wellington et al.
6,896,053 B2 5/2005 Berchenko et al.
6,902,004 B2 6/2005 de Rouffignac et al.
6,915,850 B2 7/2005 Vinegar et al.
6,918,442 B2 7/2005 Wellington et al.
6,923,257 B2 8/2005 Wellington et al.
6,932,155 B2 8/2005 Vinegar et al.
6,951,247 B2 10/2005 de Rouffignac et al.
6,951,248 B2 10/2005 Conaway et al.
6,953,087 B2 10/2005 de Rouffignac et al.
6,964,300 B2 11/2005 Vinegar et al.
6,991,032 B2 1/2006 Berchenko
6,991,033 B2 1/2006 Wellington et al.
6,991,036 B2 1/2006 Sumnu-Dindoruk et al.
6,994,160 B2 2/2006 Wellington et al.
6,994,169 B2 2/2006 Zhang et al.
6,997,518 B2 2/2006 Vinegar et al.
7,004,251 B2 2/2006 Ward et al.
7,011,154 B2 3/2006 Maher et al.
7,013,972 B2 3/2006 Vinegar et al.
7,032,660 B2 4/2006 Vinegar et al.
7,051,811 B2 5/2006 de Rouffignac et al.
7,055,600 B2 6/2006 Messier et al.
7,073,578 B2 7/2006 Vinegar et al.
7,077,198 B2 7/2006 Vinegar et al.
7,086,465 B2 8/2006 Wellington et al.
7,090,013 B2 8/2006 Wellington
7,091,460 B2 8/2006 Kinzer
7,096,942 B1 8/2006 de Rouffignac et al.
7,100,994 B2 9/2006 Vinegar et al.
7,114,566 B2 10/2006 Vinegar et al.
7,121,342 B2 10/2006 Vinegar et al.
7,344,889 B2 3/2008 Kelemen et al.
7,416,022 B2 8/2008 Maguire
7,441,603 B2 10/2008 Kaminsky et al.
7,484,561 B2 2/2009 Bridges
7,500,517 B2 3/2009 Looney et al.
7,510,000 B2 3/2009 Pastor-Sanz et al.
7,540,324 B2 6/2009 de Rouffignac et al.
7,543,638 B2 6/2009 Goodman
7,547,160 B2 6/2009 Thomas et al.
7,549,470 B2 6/2009 Vinegar et al.
7,556,096 B2 7/2009 Vinegar et al.
7,559,368 B2 7/2009 Vinegar et al.
7,562,707 B2 7/2009 Miller
7,584,789 B2 9/2009 Mo et al.
7,604,052 B2 10/2009 Roes et al.
7,631,690 B2 12/2009 Vinegar et al.
7,635,023 B2 12/2009 Goldberg et al.
7,669,657 B2 3/2010 Symington et al.
7,712,528 B2 5/2010 Langdon et al.
7,735,935 B2 6/2010 Vinegar et al.
7,770,641 B2 8/2010 Dwarakanath et al.
7,789,164 B2 9/2010 Looney et al.
7,841,407 B2 11/2010 Wellington et al.
7,841,408 B2 11/2010 Vinegar
7,845,411 B2 12/2010 Vinegar et al.
7,849,922 B2 12/2010 Vinegar et al.
7,857,056 B2 12/2010 Kaminsky et al.
7,862,705 B2 1/2011 Dana et al.
7,866,386 B2 1/2011 Beer et al.
7,906,014 B2 3/2011 Dana et al.
7,942,203 B2 5/2011 Vinegar et al.
7,950,453 B2 5/2011 Farmayan et al.
7,967,974 B2 6/2011 Dana et al.
7,980,312 B1 7/2011 Hill et al.
8,701,788 B2 4/2014 Wigand
2002/0029882 A1 3/2002 de Rouffignac et al.
2002/0033253 A1 3/2002 de Rouffignac et al.
2002/0033256 A1 3/2002 Wellington et al.
2002/0033257 A1 3/2002 Shahin, Jr. et al.
2002/0036084 A1 3/2002 Vinegar et al.
2002/0036089 A1 3/2002 Vinegar et al.
2002/0038705 A1 4/2002 Wellington et al.
2002/0038709 A1 4/2002 Wellington et al.
2002/0038710 A1 4/2002 Maher et al.
2002/0038711 A1 4/2002 de Rouffignac et al.
2002/0040173 A1 4/2002 de Rouffignac et al.
2002/0040778 A1 4/2002 Wellington et al.
2002/0040779 A1 4/2002 Wellington et al.
2002/0040780 A1 4/2002 Wellington et al.
2002/0040781 A1 4/2002 Keedy et al.
2002/0045553 A1 4/2002 Vinegar et al.
2002/0046832 A1 4/2002 Zhang et al.
2002/0046837 A1 4/2002 Wellington et al.
2002/0046838 A1 4/2002 Karanikas et al.
2002/0049360 A1 4/2002 Wellington et al.
2002/0050352 A1 5/2002 Wellington et al.
2002/0050357 A1 5/2002 Wellington et al.
2002/0052297 A1 5/2002 de Rouffignac et al.
2002/0053429 A1 5/2002 Stegemeier et al.
2002/0053431 A1 5/2002 Wellington et al.
2002/0053435 A1 5/2002 Vinegar et al.
2002/0056551 A1 5/2002 Wellington et al.
2002/0056552 A1 5/2002 Wellington et al.
2002/0057905 A1 5/2002 Wellington et al.
2002/0062052 A1 5/2002 de Rouffignac et al.
2002/0062961 A1 5/2002 Vinegar et al.
2002/0066565 A1 6/2002 de Rouffignac et al.

(56) References Cited

U.S. PATENT DOCUMENTS

| | | | |
|---|---|---|---|
| 2002/0076212 | A1 | 6/2002 | Zhang et al. |
| 2002/0084074 | A1 | 7/2002 | de Rouffignac et al. |
| 2002/0096320 | A1 | 7/2002 | Wellington et al. |
| 2003/0040441 | A1 | 2/2003 | Miller et al. |
| 2003/0062164 | A1 | 4/2003 | Wellington et al. |
| 2003/0079877 | A1 | 5/2003 | Wellington et al. |
| 2003/0098149 | A1 | 5/2003 | Wellington et al. |
| 2003/0098605 | A1 | 5/2003 | Vinegar et al. |
| 2003/0102125 | A1 | 6/2003 | Wellington et al. |
| 2003/0102130 | A1 | 6/2003 | Vinegar et al. |
| 2003/0116315 | A1 | 6/2003 | Wellington et al. |
| 2003/0130136 | A1 | 7/2003 | de Rouffignac et al. |
| 2003/0137181 | A1 | 7/2003 | Wellington et al. |
| 2003/0141067 | A1 | 7/2003 | de Rouffignac et al. |
| 2003/0142964 | A1 | 7/2003 | Wellington et al. |
| 2003/0146002 | A1 | 8/2003 | Vinegar et al. |
| 2003/0155111 | A1 | 8/2003 | Vinegar et al. |
| 2003/0173072 | A1 | 9/2003 | Vinegar et al. |
| 2003/0173080 | A1 | 9/2003 | Berchenko et al. |
| 2003/0173081 | A1 | 9/2003 | Vinegar et al. |
| 2003/0173082 | A1 | 9/2003 | Vinegar et al. |
| 2003/0183390 | A1 | 10/2003 | Veenstra et al. |
| 2003/0196789 | A1 | 10/2003 | Wellington et al. |
| 2003/0196810 | A1 | 10/2003 | Vinegar et al. |
| 2003/0201098 | A1 | 10/2003 | Karanikas et al. |
| 2003/0205378 | A1 | 11/2003 | Wellington et al. |
| 2003/0213594 | A1 | 11/2003 | Wellington et al. |
| 2004/0015023 | A1 | 1/2004 | Wellington et al. |
| 2004/0020642 | A1 | 2/2004 | Vinegar et al. |
| 2004/0149433 | A1 | 8/2004 | McQueen |
| 2005/0252656 | A1 | 11/2005 | Maguire |
| 2005/0269091 | A1 | 12/2005 | Pastor-Sanz et al. |
| 2007/0012598 | A1 | 1/2007 | Rendall |
| 2007/0023186 | A1 | 2/2007 | Kaminsky et al. |
| 2007/0137858 | A1* | 6/2007 | Considine et al. ..... 166/248 |
| 2007/0193743 | A1 | 8/2007 | Harris et al. |
| 2007/0209799 | A1 | 9/2007 | Vinegar et al. |
| 2007/0221377 | A1 | 9/2007 | Vinegar et al. |
| 2007/0284107 | A1 | 12/2007 | Crichlow |
| 2008/0006410 | A1 | 1/2008 | Looney et al. |
| 2008/0017549 | A1 | 1/2008 | Kennel et al. |
| 2008/0023197 | A1 | 1/2008 | Shurtleff |
| 2008/0059140 | A1 | 3/2008 | Salmon et al. |
| 2008/0073079 | A1* | 3/2008 | Tranquilla et al. ..... 166/270.1 |
| 2008/0087427 | A1 | 4/2008 | Kaminsky et al. |
| 2008/0087428 | A1 | 4/2008 | Symington et al. |
| 2008/0116694 | A1 | 5/2008 | Hendershot |
| 2008/0128134 | A1* | 6/2008 | Mudunuri et al. ..... 166/302 |
| 2008/0164030 | A1 | 7/2008 | Young |
| 2008/0173450 | A1 | 7/2008 | Goldberg et al. |
| 2008/0207970 | A1 | 8/2008 | Meurer et al. |
| 2008/0257552 | A1 | 10/2008 | Shurtleff et al. |
| 2008/0283241 | A1 | 11/2008 | Kaminsky et al. |
| 2008/0290719 | A1 | 11/2008 | Kaminsky et al. |
| 2008/0314593 | A1 | 12/2008 | Vinegar et al. |
| 2009/0014179 | A1 | 1/2009 | Mango |
| 2009/0014181 | A1 | 1/2009 | Vinegar et al. |
| 2009/0050319 | A1 | 2/2009 | Kaminsky et al. |
| 2009/0078415 | A1 | 3/2009 | Fan et al. |
| 2009/0101346 | A1 | 4/2009 | Vinegar et al. |
| 2009/0133935 | A1 | 5/2009 | Kinkead |
| 2009/0194282 | A1* | 8/2009 | Beer et al. ..... 166/272.7 |
| 2009/0200022 | A1 | 8/2009 | Bravo et al. |
| 2009/0200023 | A1 | 8/2009 | Costello et al. |
| 2009/0242196 | A1 | 10/2009 | Pao |
| 2009/0250381 | A1 | 10/2009 | Fan et al. |
| 2009/0313772 | A1 | 12/2009 | Talley |
| 2010/0032171 | A1 | 2/2010 | Bali et al. |
| 2010/0056404 | A1 | 3/2010 | Talley |
| 2010/0126727 | A1 | 5/2010 | Vinegar et al. |
| 2010/0173806 | A1 | 7/2010 | Fan et al. |
| 2010/0200232 | A1 | 8/2010 | Langdon et al. |
| 2010/0200234 | A1 | 8/2010 | Mango |
| 2010/0218945 | A1 | 9/2010 | Sadok |
| 2010/0270015 | A1 | 10/2010 | Vinegar et al. |
| 2010/0270038 | A1 | 10/2010 | Looney et al. |
| 2010/0282460 | A1 | 11/2010 | Stone et al. |
| 2010/0319909 | A1 | 12/2010 | Symington et al. |
| 2011/0000825 | A1 | 1/2011 | McGrady et al. |
| 2011/0049016 | A1 | 3/2011 | McGrady et al. |
| 2011/0088904 | A1 | 4/2011 | de Rouffignac et al. |
| 2011/0146982 | A1 | 6/2011 | Kaminsky et al. |
| 2011/0174496 | A1 | 7/2011 | Burnham et al. |
| 2011/0180262 | A1 | 7/2011 | O'Dowd |
| 2011/0186296 | A1 | 8/2011 | Cassidy |
| 2011/0290490 | A1 | 12/2011 | Kaminsky et al. |
| 2011/0303413 | A1 | 12/2011 | Fairbanks et al. |
| 2012/0152570 | A1 | 6/2012 | Thomas |
| 2012/0160486 | A1 | 6/2012 | Wigand et al. |
| 2012/0175114 | A1 | 7/2012 | Wigand et al. |
| 2012/0175115 | A1 | 7/2012 | Wigand et al. |
| 2012/0175116 | A1 | 7/2012 | Wigand et al. |
| 2013/0161002 | A1 | 6/2013 | Wigand |
| 2013/0161008 | A1 | 6/2013 | Klingler et al. |
| 2013/0313160 | A1 | 11/2013 | Wigand et al. |
| 2013/0326934 | A1 | 12/2013 | Wigand et al. |

FOREIGN PATENT DOCUMENTS

| | | | |
|---|---|---|---|
| WO | WO2005010320 | A1 | 2/2005 |
| WO | WO2011007172 | A2 | 1/2011 |

OTHER PUBLICATIONS

US 6,595,286, 7/2003, Fowler et al. (withdrawn).

Vandenbrouck, M. et al., "Kerogen origin, evolution and structure", *Organic Geochemistry* 38:719-833 (2007).

Philp, R.P. et al., "Saponification of the Insoluble Organic Residues from Oil Shales, Algal Oozes, and Algae", *Energy Sources* 4(2): 113-123 (1978).

Huseby, B. and Ocampo, R, "Evidence for porphyrins bound, via ester bonds, to the Messel oil shale kerogen by selective chemical degradation experiments", *Geochimica et Cosmochimica Acta* 61(18):3951-3955 (1997).

Ambles, A., et al., "Ester- and ether bond cleavage in immature kerogens", *Org. Geochem* 24(6/7):681-690 (1996).

McGowan, C.W., et al., "A Comparison of the Dissolution of Model Compounds and the Kerogen of Green River Oil Shale by Oxidation with Perchloric Acid—A Model for the Kerogen of the Green River Oil Shale", *Fuel Processing Technology* 10:195-204 (1985).

McGowan, Chris W., "The Oxidation of Green River Oil Shale with Perchloric Acid—Part I—The Reaction of Green River Oil Shale with Perchloric of Varying Concentration and Boiling Point", *Fuel Processing Technology* 10:169-179 (1985).

McGowan, Chris W., et al., "The Role of Ether Oxygen and Carbon Double Bonds as Linkages During the Dissolution of Kerogens with Perchloric Acid" *ACS Fuel* 42(1):172-175 (Spring 1997).

Boucher, Raymond J., et al., "Molecular characterization of kerogens by mild selective chemical degradation—ruthenium tetroxide oxidation", *Fuel* 70:695-708 (1991).

Robinson, W.E., et al., "Alkaline Permanganate Oxidation of Oil-Shale Kerogen", *Industrial and Engineering Chemistry* 45(4):788-791 (1953).

Djuricic, M., et al., "Organic acids obtained by alkaline permanganate oxidation of kerogen from the Green River (Colorado) shale", *Geochimica et Cosmochimica Acta* 35:1201-1207 (1971).

Young, D.K. and Yen, T.F., "The nature of straight-chain aliphatic sstructures in Green River kerogen", *Geochimica et Cosmochimica Acta* 41:1411-1417 (1977).

Amblès, A., et al., "Nature of Kerogen from Green River Shale based on the Charactyer of the Products of a Forty-Step Alkaline Permanganate Oxidation", *Adv. Org. Geochem* 554-560 (1981).

Vitorović, D., et al., "Improvement of kerogen structural interpretations based on oxidation products isolated from aqueous solutions", *Advances in Organic Geochemistry* 10:1119-1126 (1985).

Vitorović, D., et al., "Relationship between kerogens of various structural types and the products of their multistep oxidative degradation", *Org. Geochem*. 6:333-342 (1984).

(56) References Cited

OTHER PUBLICATIONS

Vitorović, D., et al., "The feasibilities of the alkaline permanganate degradation method for the characterization and classification of kerogens", *J. Serb. Chem. Soc.* 53(4):175-189 (1988).
Burlingame, A.L. and Simoneit, B.R., "High Resolution Mass Spectrometry of Green River Formation Kerogen Oxidations", *Nature* 222:741-747 (1969).
Simoneit, B.R., et al., "Sterochemical studies of acyclis isoprenoid compounds—V. Oxidation products of Green River Formation oil shale kerogen", *Geochimica et Cosmochimica Acta* 39:1143-1145 (1975).
Burlingame, A.L. and Simoneit, B.R., "Isoprenoid Fatty Acids Isolated from the Kerogen Matrix of the Green River Formation (Eocene)", *Science* 160:531-533 (1968).
Simoneit, B.R. and Burlingame, A.L., "Carboxylic acids derived from Tasmanian tasmanite by extractions and kerogen oxidations", *Geochimica et Cosmochimica Acta* 37:595-610 (1973).
Hayatsu, Ryoichi, et al., "Investigation of aqueous sodium dichromate oxidation for coal structural studies", *Fuel* 60:77-82 (1981).
Barakat, A.O. and Yen, T.F., "Distribution of Acyclic Isoprenoids in Fractions from Stepwise Oxidation of Greene River Kerogen", *Energy Sources* 10:253-259 ((1988).
Barakat, A.O., "Carboxylic Acids Obtained by Alkaline Hydrolysis of Monterey Kerogen", *Energy and Fuels* 7:988-993 (1993).
Barakat, Assem O., Size Distribution of the Straight-Chain Structures in Type I and II Kerogens, *Energy and Fuels* 2:181-185 (1988).
Barakat, A.O. and Yen, T.F., "Distribution of pentacyclic triterpenoids in Green River oil shale kerogen", *Org. Geochem.* 15(3):299-311 (1990).
Barakat, A.O. and Yen, T.F., "The Nature of Porphyrins in Kerogen. Evidence of Entrapped Etioporphyrin Species", *Energy & Fuels* 3:613-616 (1989).
Barakat, A.O. and Yen, T.F., "Novel Identification of 17β(H)-Hopanoids in Green River Oil Shale Kerogen", *Energy & Fuels* 2:105-108 (1988).
Philp et al., "Alkaline Potassium Permanganate Degradation of Insoluble Organic Residues ) Kerogen( Isolated from Recently-Deposited Algal Mats", *Energy Sources*, 3:2, 149-161, May 16, 2007.
Robinson et al., "Constitution of Organic Acids Prepared from Colorado Oil Shale Based η-Butyl Esters," Petroleum and Oil-Shale Experiment Station, U.S. Bureau of Mines, Laramie, Wyoming, *Industrial and Engineering Chemistry*, Jul. 1956, vol. 48, No. 7, pp. 1134-1138.
Hayatsu et al., "Is kerogen-like material present in coal? 1. Buffer-controlled permanganate oxidation of coal," Chemistry Division, Argonne National Laboratory, Argonne, Illinois 60439, USA, *Fuel*, 1981, vol. 60, February, pp. 158-161.
Barakat et al., "Kerogen structure by stepwise oxidation, Use of sodium dichromate in glacial acetic acid," Department of Environment and Civil Engineering, University of Southern California, Los Angeles, CA 90089-0231, USA, *Fuel*, 1987, vol. 66, May pp. 587-593.
Philip et al., "Alkaline Potassium Permanganate Degradation of Insouble Organic Residues (Kerogen) Isolated from Recently-Deposited Algal Mats," *Energy Sources*, 1977, vol. 3, No. 2, pp. 149-161.
Reynolds, David A. et al., "Electrokinetic Migration of Permanganate Through Low-Permeability Media" Ground Water, 2008, 9 pages.

* cited by examiner

ELECTROKINETIC ENHANCED HYDROCARBON RECOVERY FROM OIL SHALE

RELATED APPLICATION

This application is a continuation-in-part of U.S. patent application Ser. No. 13/161,885, filed Jun. 16, 2011 (US Patent Publication No. US 2012-0152570), the contents of which are incorporated herein by reference in their entirety. U.S. patent application Ser. No. 13/161,885 claims the benefit of U.S. Provisional Application No. 61/425,517 filed Dec. 21,2010. The subject application is also related to U.S. Provisional Application No. 61/426,340, filed Dec. 22, 2010; U.S. patent application Ser. No. 13/335,409 (US Patent Publication No. US 2012-0160486), entitled "In-Situ Kerogen Conversion and Recovery" filed Dec. 22, 2011; U.S. patent application Ser. No. 13/335,525 (US Patent Publication No. US 2012-0175114), entitled "In-Situ Kerogen Conversion and Product Isolation" filed Dec. 22, 2011; U.S. patent application Ser. No. 13/335,607 (US Patent Publication No. US 2012-0175115), entitled "In-Situ Kerogen Conversion and Upgrading" filed Dec. 22, 2011; U.S. patent application Ser. No. 13/335,673 (US Patent Publication No. US 2012-0175116), entitled "In-Situ Kerogen Conversion and Recycling" filed Dec. 22, 2011; and U.S. patent application Ser. No. 13/335,290 (US Patent Publication No. US 2013-0161008), entitled "Preparation and Use of Nano-Catalysts for In-Situ Reaction with Kerogen" filed Dec. 22, 2011. The contents of all of these related applications are incorporated herein by reference in their entirety.

BACKGROUND

If proponents of Hubbert peak theory are correct, world oil production will soon peak, if it has not done so already. Regardless, world energy consumption continues to rise at a rate that outpaces new oil discoveries. As a result, alternative sources of energy must be developed, as well as new technologies for maximizing the production and efficient consumption of oil. See T. Mast, Over a Barrel: A Simple Guide to the Oil Shortage, Greenleaf Book Group, Austin, Tex., 2005.

A particularly attractive alternative source of energy is oil shale, the attractiveness stemming primarily from the fact that oil can be "extracted" from the shale and subsequently refined in a manner much like that of crude oil. Technologies involving the extraction, however, must be further developed before oil shale becomes a commercially-viable source of energy. See J. T. Bartis et al, Oil Shale Development in the United States: Prospects and Policy Issues, RAND Corporation, Arlington, Va., 2005.

The largest known deposits of oil shale are found in the Green River Formation, which covers portions of Colorado, Utah, and Wyoming. Estimates on the amount of recoverable oil from the Green River Formation deposits are as high as 1.1 trillion barrels of oil—almost four times the proven oil reserves of Saudi Arabia. At current U.S. consumption levels (~20 million barrels per day), these shale deposits could sustain the U.S. for another 140 years (Bartis et al.) At the very least, such shale resources could moderate the price of oil and reduce U.S. dependence on foreign oil.

Oil shale typically consists of an inorganic component (primarily carbonaceous material, i.e., a carbonate), an organic component (kerogen) that can only be mobilized by breaking the chemical bonds in the kerogen, and frequently a second organic component (bitumen). Thermal treatment can be employed to break (i.e., "crack") the kerogen into hydrocarbon chains or fragments, which are gas or liquids under retort conditions, and facilitate separation from the inorganic material. This thermal treatment of the kerogen is also known as "thermal upgrading" or "retorting," and can be done at either the surface or in situ, where in the latter case, the fluids so formed are subsequently transported to the surface.

In some applications of surface retorting, the oil shale is first mined or excavated, and once at the surface, the oil shale is crushed and then heated (retorted) to complete the process of transforming the oil shale to a crude oil—sometimes referred to as "shale oil." See, e.g., Shuman et al., U.S. Pat. No. 3,489,672. The crude oil is then shipped off to a refinery where it typically requires additional processing steps (beyond that of traditional crude oil) prior to making finished products such as gasoline, lubricant, etc. Note that various chemical upgrading treatments can also be performed on the shale prior to the retorting, See, e.g., So et al., U.S. Pat. No. 5,091,076.

A method for in situ retorting of carbonaceous deposits such as oil shale has been described in Kvapil et al., U.S. Pat. No. 4,162,808. In this method, shale is retorted in a series of rubblized in situ retorts using combustion (in air) of carbonaceous material as a source of heat.

The Shell Oil Company has been developing new methods that use electrical heating for the in situ upgrading of subsurface hydrocarbons, primarily in subsurface formations located approximately 200 miles (320 km) west of Denver, Colo. See, e.g., Vinegar et al., U.S. Pat. No. 7,121,342; and Berchenko et al., U.S. Pat. No. 6,991,032. In such methods, a heating element is lowered into a well and allowed to heat the kerogen over a period of approximately four years, slowly converting (upgrading) it into oils and gases, which are then pumped to the surface. To obtain even heating, 15 to 25 heating holes could be drilled per acre. Additionally, a ground-freezing technology to establish an underground barrier around the perimeter of the extraction zone is also envisioned to prevent groundwater from entering and the retorting products from leaving. While the establishment of "freeze walls" is an accepted practice in civil engineering, its application to oil shale recovery still has unknown environmental impacts. Additionally, the Shell approach is recognized as an energy intensive process and requires a long timeframe to establish production from the oil shale.

In view of the aforementioned limitations of the above methods, simpler and more cost-effective methods of extracting the kerogen from the shale would be extremely useful.

SUMMARY OF THE INVENTION

The present invention is directed to processes for producing mobile products from the organic matter that occurs in subsurface oil shale. Among other factors, these processes are based on the discovery that kerogen in oil shale can be made to react at temperatures below pyrolysis temperatures to produce mobile reaction products that can be removed from the subsurface shale formation, recovered in surface facilities and upgraded to produce useful products, refinery feedstocks, fuel and lubricant blendstocks, reaction intermediates and the like. The presently disclosed processes are more environmentally benign, more economical, and more efficient in producing commercial products.

Disclosed herein is a process for extracting a kerogen-based product from a subsurface shale formation comprising kerogen, using a chemical oxidation. The multi-step extraction process, including the oxidation step, is generally conducted at temperatures near the natural reservoir temperature.

In embodiments, the oxidation step is conducted at a temperature in the range of from 0° C. to 200° C.

In the process, kerogen conversion reactions, the oxidant regeneration reactions and the product extraction are conducted at the same, or at different, pH ranges. In embodiments, at least one of the conversion, regeneration and extraction steps are conducted with a formation fluid that is present in the subsurface shale formation.

Further to the invention is the discovery that an oxidant that is useful for the chemical oxidation of kerogen may be induced to migrate to the kerogen in the subsurface shale using electrokinetics. Electrodes with an applied electrical potential, sited at an injection well and within a kerogen rich zone in the subsurface shale formation, induce the migration of the oxidant to the kerogen. Likewise, electrodes with an applied electrical potential, sited within the kerogen rich zone and at a production well, induce migration of the reaction products to the production well. Further electrodes with an applied electrical potential, sited within the kerogen rich zone in the subsurface shale formation can be used to induce migration of catalysts and catalyst precursors.

Accordingly, disclosed herein is a process for extracting a kerogen-based product from a subsurface shale formation having a kerogen rich zone, comprising: providing an injection well and a production well that extend into a subsurface shale formation and are in fluid communication therewith; injecting an oxidant into the subsurface shale formation through the injection well; generating an electric field through at least a portion of the subsurface shale formation to induce electrokinetic migration of the oxidant; contacting the kerogen in the subsurface shale formation with the oxidant at a temperature in the range of between 0° C. and 200° C. to form organic acids; and mobilizing at least a portion of the organic acids from the subsurface shale formation through the production well to produce a mobile kerogen-based product.

In a further embodiment, the process comprises: providing an injection well and a production well that extend into a subsurface shale formation and are in fluid communication therewith; injecting an oxidant into the subsurface shale formation through the injection well; contacting the kerogen in the subsurface shale formation with the oxidant at a temperature in the range of between 0° C. and 200° C. to form organic acids; and mobilizing at least a portion of the organic acids from the subsurface shale formation through the production well to produce a mobile kerogen-based product; and generating an electric field through at least a portion of the subsurface shale formation to induce electrokinetic migration of the mobile kerogen-based product to a production well.

In a further embodiment, the process comprises: providing an injection well and a production well that extend into a kerogen rich zone of a subsurface shale formation and are in fluid communication therewith; providing a plurality of electrodes interspersed within the kerogen rich zone of a subsurface shale formation; injecting an oxidant into the kerogen rich zone through the injection well; emitting a direct current between the plurality of electrodes to induce electrokinetic migration of the oxidant; and recovering hydrocarbons from the kerogen rich zone of the subsurface shale formation through the production well.

The process is also useful for introducing a catalyst or catalyst precursor into the subsurface shale formation. The catalyst or catalyst precursor can be induced to migrate to be deposited on or adhere to the surface of the kerogen or into the pores of the kerogen. In this embodiment, the process comprises injecting a catalyst or catalyst precursor into the subsurface shale formation and generating an electric current through at least a portion of the subsurface shale formation to induce electrokinetic migration of the catalyst or catalyst precursor.

In a further embodiment, the process comprises: providing an injection well and a production well that extend into a subsurface shale formation and are in fluid communication therewith; injecting an catalyst or catalyst precursor into the subsurface shale formation through the injection well; generating an electric field through at least a portion of the subsurface shale formation to induce electrokinetic migration of the catalyst or catalyst precursor; contacting the kerogen in the subsurface shale formation with the catalyst precursor at a temperature in the range of between 0° C. and 200° C. to form kerogen conversion products; and mobilizing at least a portion of the kerogen conversion products through the production well to produce a mobile kerogen-based product.

In a further embodiment, the process comprises: providing an injection well and a production well that extend into a subsurface shale formation and are in fluid communication therewith; injecting a catalyst or catalyst precursor into the subsurface shale formation through the injection well; contacting the kerogen in the subsurface shale formation with the catalyst or catalyst precursor at a temperature in the range of between 0° C. and 200° C. to form kerogen conversion products; mobilizing at least a portion of the kerogen conversion products from the subsurface shale formation through the production well to produce a mobile kerogen-based product; and generating an electric field through at least a portion of the subsurface shale formation to induce electrokinetic migration of the mobile kerogen-based product to the production well.

In a further embodiment, the process further comprises adjusting the direct current emitted between one or more of the plurality of electrodes such that the reactive fluid migrates to unswept areas of the kerogen rich zone.

DETAILED DESCRIPTION OF THE INVENTION

Introduction

Figure 1:
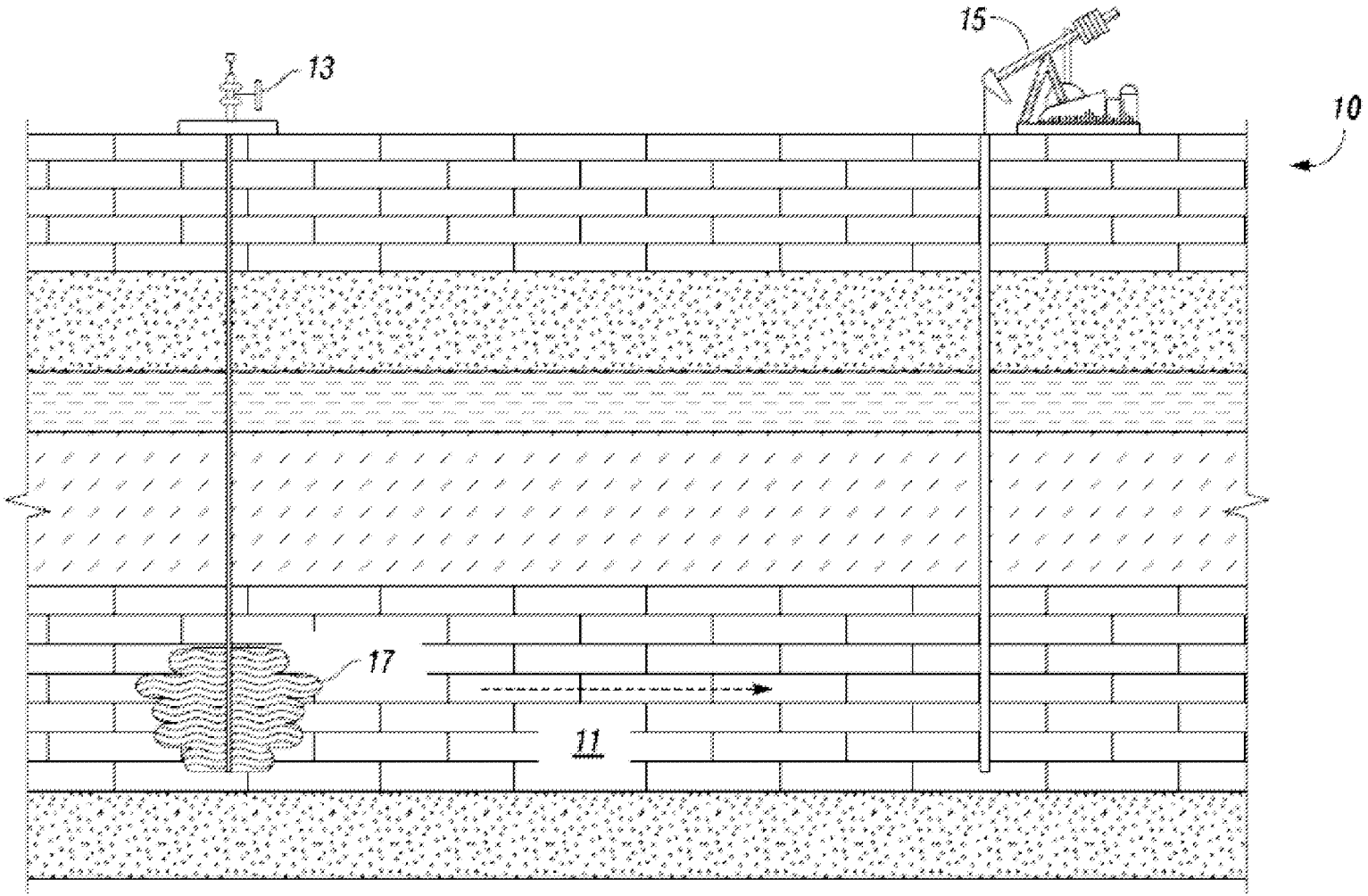
FIG. 1 is a schematic sectional view of an example oil recovery system that includes a reservoir that is in fluid communication with an injection well and a production well during enhanced oil recovery operations, in accordance with an embodiment of the present invention.

The present invention is directed to methods of extracting a kerogen-based product from subsurface shale formation comprising kerogen in an inorganic matrix. The methods rely on chemically modifying the shale-bound kerogen to render it mobile using an oxidant that is provided to the kerogen in the subsurface shale in a liquid medium by induced migration, using electrokinetics. The oxidant converts the kerogen to a mobile kerogen-based product at temperatures below that at which the kerogen thermally decomposes by pyrolysis or thermal cracking The oxidant is maintained in the subsurface shale formation for sufficient time to significantly reduce the oxidation activity of the oxidant. The methods may also rely on chemically modifying the shale-bound kerogen to render it mobile using catalysts. The present invention is also directed to systems for implementing such methods.

The process is for the conversion of carbonaceous deposits into mobile products, which may be recovered for use in the generation of energy and/or in the production of fuels, lubricants, solvents and/or petrochemicals that are generally formed during petroleum processing and refining. Any carbonaceous deposit may be beneficially treated by the process. Exemplary deposits include oil shale, coal, tar sands, heavy oil and the like. In the following description of the process, specific attention is paid to converting the hydrocarbonaceous material that occurs in what is commonly termed "oil shale", with the understanding that application of the process in its general form is not so limited.

Definitions

In accordance with this detailed description, the following abbreviations and definitions apply. It must be noted that as used herein, the singular forms "a", "an", and "the" include plural referents unless the context clearly dictates otherwise. Thus, for example, reference to an "oxidant" includes a plurality of such.

As used herein, a range encompasses all values within the limits of the stated range, including the end members of the range. In an illustrative example, "having a pH in a range from 8 to 12" includes all integer and fractional values from 8 and 12, including a pH of 8 or a pH of 12.

As used herein, the terms "hydrocarbon" or "hydrocarbonaceous" or "petroleum" are used interchangeably to refer to material originating from oil shale, coal, tar sands, crude oil, natural gas or biological processes. Carbon and hydrogen are major components of hydrocarbons; minor components, such as oxygen, sulfur and nitrogen may also occur in some hydrocarbons. The hydrocarbon fraction includes both aliphatic and aromatic components. The aliphatic component can further be divided into acyclic alkanes, referred to as paraffins, and cycloalkanes, referred to as naphthenes. A paraffin refers to a non-cyclic, linear (normal paraffin) or branched (isoparaffin) saturated hydrocarbon. For example, a $C_8$ paraffin is a non-cyclic, linear or branched hydrocarbon having 8 carbon atoms per molecule. Normal octane, methylheptane, dimethylhexane, and trimethylpentane are examples of $C_8$ paraffins. A paraffin-rich feed comprises at least 10 wt %, at least 20 wt % or even at least 30 wt % paraffins. For example, a $C_8$ rich paraffinic feedstock contains at least 10 wt. % $C_8$ hydrocarbons.

As disclosed herein, boiling point temperatures are based on the ASTM D-2887 standard test method for boiling range distribution of petroleum fractions by gas chromatography, unless otherwise indicated. The mid-boiling point is defined as the 50% by volume boiling temperature, based on an ASTM D-2887 simulated distillation.

As disclosed herein, carbon number values (i.e., $C_5$, $C_6$, $C_8$, $C_9$ and the like) generally refers to a number of carbon atoms within a molecule. Carbon number ranges as disclosed herein (e.g., $C_8$ to $C_{12}$) refer to molecules having a carbon number within the indicated range (e.g., between 8 carbon and 12 carbon atoms), including the end members of the range. Likewise, an open ended carbon number range (e.g., $C_{35}$+) refers to molecules having a carbon number within the indicated range (e.g., 35 or more carbon atoms), including the end member of the range. As described herein, carbon number distributions are determined by true boiling point distribution and gas liquid chromatography.

Unless otherwise specified, feed rate to a catalytic reaction zone is reported as the volume of feed per volume of catalyst per hour. In effect, the feed rate as disclosed herein, referred to as liquid hourly space velocity (LHSV), is reported in reciprocal hours (i.e., $hr^{-1}$).

As used herein, the value for octane refers to the research octane number (RON), as determined by ASTM D2699.

The term "surface facility" as used herein is any structure, device, means, service, resource or feature that occurs, exists, takes place or is supported on the surface of the earth. The kerogen products that are generated in the process disclosed herein are recovered in surface facilities and upgraded or transported for upgrading.

"Shale," as defined herein, generally refers to "oil shale" and is a general term applied to a group of rocks rich enough in organic material (called kerogen) to yield petroleum upon pyrolysis and distillation. Such shale is generally subsurface and comprises an inorganic (usually carbonate) component or matrix in addition to the kerogen component.

A "subsurface shale formation," as defined herein, is an underground geological formation comprising (oil) shale. The subsurface shale formation comprises kerogen in an inorganic matrix.

A "low-permeability hydrocarbon-bearing formation," as defined herein, refers to formations having a permeability of less than about 10 millidarcies, wherein the formations comprise hydrocarbonaceous material. Examples of such formations include, but are not limited to, diatomite, coal, tight shales, tight sandstones, tight carbonates, and the like.

"Kerogen," as defined herein and as mentioned above, is an organic component of shale. On a molecular level, kerogen comprises very high molecular weight molecules that are generally insoluble by virtue of their high molecular weight and likely bonding to the inorganic component or matrix of the shale. In a geologic sense, kerogen is a precursor to crude oil. Kerogen is typically identified as being one of five types: Type I, Type II, Type II-sulfur, Type III, or Type IV, based on its C:H:O ratio and sulfur content, the various types generally being derived from different sources of ancient biological matter.

"Kerogen-based," and "kerogen-derived are terms used herein to denote a molecular product or intermediate derived from kerogen, such derivation requiring a chemical modification of the kerogen, and the term being exclusive of derivations carried out over geologic timescales.

"Extractible organics" are organic components of the subsurface shale formation that are at least partially soluble in an organic solvent. In contrast, the kerogen is not soluble in organic solvent. This organic component that is at least partially soluble is referred to herein as "extractible organics". This extractible organic component includes what is commonly referred to as "bitumen". The extractable organic component is a solid or semi-solid material that is soluble or at least partially soluble in an organic solvent. As such, the extractable organic component can be removed by extraction using an organic solvent. Extraction of the extractable organic component makes the kerogen more accessible. In the present methods, extraction of the extractable organic component makes the kerogen more accessible to oxidants and/or catalysts for reaction to create mobile kerogen-based product. Extraction of the extractable organic component is disclosed in U.S. application Ser. No. 13/335,195(US Patent Publication Number US 2013-0161001), entitled "Preconditioning a Subsurface Shale Formation by Removing Extractable Organics", filed Dec. 22, 2011, the contents of which are incorporated herein by reference in their entirety.

"Organic acid" is a term used herein to denote a molecular entity containing at least one carboxylic acid functional group, either in the non-ionized form (e.g., —COOH), in the ionized form (e.g., —COO—), or salts thereof. The term "organic acid" is meant to encompass a high molecular weight kerogen fragment (e.g., a molecular mass of up to 12,000 to 15,000 daltons and higher) comprising at least one carboxylic acid functional group. The term "organic acid" is further meant to encompass a low molecular weight acid, including a monoacid such as acetic acid and a diacid such as oxalic acid. As used herein, the term "monoacid" is used to denote having one carboxylic acid functional group per molecule. Likewise, the term "diacid" denotes two, and "triacid" denotes three carboxylic acid functional groups per molecule.

The term "reactive fluid," as used herein, refers to fluid comprising an oxidant that is passed to the kerogen in the subsurface shale formation.

The term "extractive fluid," as used herein, refers to a fluid that is prepared with additives for mobilizing the organic acid reaction products in the subsurface shale.

The term "aqueous fluid" as used herein refers to any water containing fluid, including pure water, such as, municipal water; surface water, including from a lake, sea, ocean, river, and/or stream; formation water; water associated with industrial activity; or mixtures thereof.

The term "formation water" as used herein refers to the water or aqueous fluid that is naturally occurring in a geological formation, such as the subsurface shale formation, or in a subsurface aquifer. The amount (or presence) of formation water in the formation, and the amount (or presence) of formation water in contact with the kerogen in the formation, depends on a number of factors, including the depth of the subsurface shale formation or the kerogen deposit located therein. In some cases, formation water is present in the formation prior to the start of the process for extracting a kerogen-based product from a subsurface shale formation. The naturally occurring formation water may contain dissolved alkali materials from naturally occurring deposits in the environment of the subsurface shale.

The term "formation fluid" as used herein, is the fluid in contact with the kerogen in the subsurface shale formation. Formation fluid may include the formation water that occurs naturally at, or in the environment of, the subsurface shale. Formation fluid may also include, for example, a fluid (or fluids) that is supplied to the kerogen from the surface. Formation fluid may also include, for example, oxidants, or surfactants, or alkali materials, or mixtures thereof that are supplied from the surface. Formation fluid may also include reaction products from chemical reactions and/or physical absorption processes of the kerogen (and/or bitumen) in the subsurface shale formation.

The term "spent formation fluid," as used herein, refers to the oxidation activity of the formation fluid, and by extension the concentration of oxidant in the formation fluid. A spent formation fluid has a reduced amount of oxidant, and therefore a reduced oxidation activity toward the conversion of kerogen or products from kerogen conversion. Unless otherwise indicated, a spent formation fluid is one which produces an insignificant amount of reaction products at the temperature of the fluid over the time in which the fluid is withdrawn as a mobile kerogen-based product from the formation.

The terms "natural" or "naturally occurring" refer to conditions existing before, or without, human intervention. Thus, a "natural formation temperature," as used herein, refers to the temperature of the subsurface shale formation, prior to or in the absence of human intervention with or in the formation. In a specific example, a naturally occurring aqueous fluid may originate from a subterranean aquifer or from a surface body of water such as a river or stream or from a pond or lake that has not been modified by man. In another specific example, a "naturally occurring" aqueous basic solution refers to a solution present in the formation prior to, or in the absence of, human intervention in the formation.

A "surfactant" as used herein refers to any substance that reduces surface tension of a liquid, or reduces interfacial tension between two liquids, or between a liquid and a solid, or facilitates the dispersion of an organic material into an aqueous solution.

The term "basic solution," as used herein, refers to an aqueous solution having a pH of greater than 7.

The term "acidic solution," as used herein, refers to an aqueous solution having a pH of less than 7.

A "dense phase fluid," as defined herein, is a non-gaseous fluid. Such dense phase fluids include liquids, supercritical fluids (SCFs), and fluids at supercritical conditions. The dense phase fluid can be any such fluid that suitably provides for increased accessibility of the kerogen to a fluid—typically due to fracturing and/or rubblizing of the shale in which the kerogen resides.

A "supercritical fluid," as used herein, is any substance at a temperature and pressure above its thermodynamic critical point. Supercritical fluids can be regarded as "hybrid solvents" with properties between those of gases and liquids, i.e., a solvent with a low viscosity, high diffusion rates and no surface tension. Common supercritical fluids include supercritical carbon dioxide ($CO_2$) and supercritical water. For example, the critical temperature of $CO_2$ is 31.1° C., and the critical pressure of $CO_2$ is 72.9 atm (7.39 MPa).

The term "mechanical stress," as used herein, refers to structural stresses within the shale formation that result from pressure variations within the formation. Such stress can lead to fracturing and/or rubblization of the shale formation.

The term "thermal stress," as used herein, refers to structural stresses within the shale formation that result from thermal variations. Such thermal stresses can induce internal mechanical stresses as a result of differences in thermal coefficients of expansion among the various components of the shale formation. Like mechanical stress mentioned above, thermal stress can also lead to fracturing and/or rubblization of the shale formation.

The term "fracturing," as used herein, refers to the structural degradation of a subsurface shale formation as a result of applied thermal and/or mechanical stress. Such structural degradation generally enhances the permeability of the shale to fluids and increases the accessibility of the kerogen component to such fluids. The term "rubblization," as used herein, is a more extensive fracturing process yielding fracture planes in multiple directions that generate shale derived "rubble."

The term "cracking," as mentioned in the background section and as used herein, refers to the breaking of carbon-carbon bonds in the kerogen so as to yield species of lower molecular weight. "Retorting," provides thermal cracking of the kerogen. "Upgrading," provides cracking of the kerogen, but can involve a thermal or chemical upgrading agent. Accordingly, the term "thermal upgrading" is synonymous with the term "retorting."

Hydrocracking is a chemical reaction of liquid feed materials, including hydrocarbons, petroleum and other biologically derived material, in the presence of hydrogen and one or more catalysts, resulting in product molecules having reduced molecular weight relative to that of the liquid feed materials. Additional reactions, including olefin and aromatic saturation and heteroatom (including oxygen, nitrogen, sulfur and halogen) removal may also occur during hydrocracking.

Pyrolysis temperature, as used herein, is the temperature at which the kerogen thermally decomposes without the intervention of a catalytic or chemical agent.

The term "in situ," as used herein refers to the environment of the subsurface shale formation.

The term "commercial petroleum-based products," as used herein, refers to commercial products that include, but are not limited to, gasoline, aviation fuel, diesel, lubricants, petrochemicals, and the like. Such products can also include common chemical intermediates and/or blending feedstocks.

"Optional" or "optionally" means that the subsequently described event or circumstance may, but need not, occur, and that the description includes instances where the event or circumstance occurs and instances in which it does not.

Method Overview

The present invention is generally directed to methods for extracting a kerogen-based product from a subsurface shale formation comprising subsurface shale. The methods include the steps of: providing a first oxidant to kerogen in subsurface shale; contacting the kerogen in the subsurface shale with the first oxidant at a temperature in the range from 0° C. and 200° C. to form organic acids; mobilizing at least a portion of the organic acids from the subsurface shale to produce a mobile kerogen-based product; and regenerating the first oxidant in the subsurface shale.

The methods for extracting a kerogen-based product from a subsurface shale formation may also rely on using metal particulate catalysts. The metal particulate catalysts can be used for in-situ reaction of kerogen to create mobile kerogen-based products.

The step of contacting the kerogen with an oxidant generally involves an in situ chemical modification of the kerogen (e.g., cracking) and/or surrounding shale so as to render the modified kerogen component mobile. Such chemical modification generally involves the making and/or breaking of chemical bonds. In one embodiment, the chemical modification involves the formation of reaction products that contain organic acid and/or organic acid functional groups. At least a portion of these reaction products may be mobilized using an alkaline aqueous solution. The step of transporting the mobile kerogen-based product out of the subsurface shale formation can generally be described as a means of flowing the mobile kerogen-based product out of the subsurface formation, where such a means can be active (e.g., pumping) and/or passive.

The metal particulate catalysts can be used for in-situ reaction of kerogen to create mobile kerogen-based products. The metal particulate catalysts catalyze reactions creating mobile kerogen-based products.

In an embodiment, the step of isolating the organic acids from the mobile kerogen-based product involves reducing the relative solubility of the organic acids in the mobile kerogen-based product. One exemplary method involves converting an ionized form of the acid, e.g., a salt of the acid such as a sodium salt, to the corresponding protonated (e.g., non-ionized) form of the acid. In another embodiment, reducing the relative solubility involves contacting the mobile kerogen-based product with a hydrocarbonaceous extractant for extracting at least some of the organic acids from the mobile kerogen-based product to the hydrocarbonaceous extractant. In another embodiment, reducing the relative solubility involves converting the acid to a corresponding ester. In an embodiments, the step of isolating the soluble organic acids involves separating the acids from a carrier fluid by physical means, such as, for example, liquid-liquid separation, distillation, membrane separation, froth flotation, phase separation, electrostatic separation, coalescence, biological processes, thermal separation processes, and steam distillation.

In one embodiment, the above-described method may involve one or more additional steps which serve to sample and subsequently analyze the shale prior to, or in the alternative during, or in the alternative after, performing the step of increasing the accessibility of the kerogen. Such sampling and analysis can have a direct bearing on the techniques employed in the subsequent steps.

In one embodiment, the extracted kerogen-based product is upgraded (thermally and/or chemically) in a surface facility. Such surface upgrading can be intermediate to subsequent refining.

In an illustrative embodiment, a reactive fluid containing at least one reactive component and having a pH of at least 7 is provided to the kerogen in the subsurface shale. The reactive component facilitates cracking reactions in the kerogen, producing mobile organic acid reaction products. The mobile reaction products are absorbed into an aqueous fluid to form a mobile kerogen-based product; the reaction product enriched aqueous fluid is then removed to surface facilities for processing. A reactive fluid may further be provided to the subsurface shale for dissolving or otherwise absorbing mobile reaction products for removal to surface facilities for processing. In another illustrative embodiment, the reactive fluid containing at least one reactive component, and having a pH of less than or equal to 7 is provided to the kerogen in the subsurface shale.

The subsurface shale formation comprises an organic component, at least a portion of which is the kerogen as defined herein. The subsurface shale formation further comprises an inorganic component in addition to the kerogen.

The subsurface shale formation is accessed from the surface through at least one well. In general, the well will be cased, at least for a portion of its distance. Specifications for drilling access wells into a subsurface shale formation are known. In most applications of the invention, multiple wells will be provided into the subsurface shale formation, the well pattern based on recognized principles for this application. In one embodiment, a portion of the wells are employed as injection wells for passing fluids from the surface to the formation, and a portion of the wells are employed as production wells for withdrawing fluids from the formation to the surface. Each of the multiple wells may be used successively as an injection well and a production well, depending on the needs of the process. In an alternative, each well may be prepared and managed optimally as either an injection well or a production well. Specifications of each well for preparing and using the well as an injection well and/or a production well can readily be developed by one of skill in the art.

Conversion Process

The conversion process is a chemical conversion process, with reagents being provided to the kerogen to facilitate the fracture of chemical bonds in the kerogen and between the kerogen and the inorganic matrix in which the kerogen naturally occurs. While the reagents that are provided to convert the shale may be provided as solids, liquids or gases, it has been found that the conversion reactions are facilitated by the introduction of liquid phase materials, or alternatively by using liquid phase materials that are naturally present in the shale formation, for converting the kerogen. Use of liquid phase oxidants during kerogen cracking conversion may advantageously be conducted at liquid phase temperatures, including temperatures in the range from 0° C. to 200° C. The kerogen cracking conversion may advantageously be conducted at formation pressure, or at a pressure sufficiently above formation pressure to permit provision of liquid phase reactants to the kerogen in the oil shale formation.

Oxidant

In one embodiment, the process includes providing an oxidant to kerogen in subsurface shale. Depending on the oxidant, it may be provided in solid, liquid or gaseous form. In liquid form, the oxidant may be provided in acidic, neutral, or alkaline conditions; the choice of pH depends at least in part on the type of oxidant used. Some oxidants are better suited for acidic conditions. For oxidants of this type, the oxidant is provided to the kerogen at a pH in a range from 1.5 to 6.5. Maintaining the pH in this range will generally require the addition of an acidic material to the kerogen. Examples include mineral acids such as hydrochloric acid, sulfuric acid, nitric acid, phosphoric acid and combinations thereof, or organic acids such as one or more of the carboxylic acids having from 2 to 15 carbon atoms, or mixture thereof may be used. With the carboxylic acids, monoacids, diacids, or triacids may be used. In one embodiment, the pH is maintained in a range from 1.5 to 6.5 by provision of $CO_2$ to the kerogen, alone or in combination with other acids.

Some oxidants are better suited for conditions at neutral pH. Supplying oxidants of this type generally involves supplying the oxidants in combination with a buffered solution, to maintain the pH in the neutral range while contacting the mineral matter within the subsurface shale.

In one embodiment, the oxidant is provided to the kerogen at a pH in a range from 7 to 14, with an embodiment in the range from 7 to 9. Maintaining the pH in the desired alkaline range will be facilitated in some situations by the carbonate and bicarbonate materials that are natural to the subsurface shale formation. Otherwise, the pH in the range from 7 to 14, or in the range from 7 to 9, may be maintained by supply of an alkaline material, such as a carbonate, a bicarbonate, an oxide, a hydroxide, or combinations thereof. In one embodiment, the pH is maintained in a range from 7 to 9 by provision of $CO_2$ to the kerogen.

In one embodiment, the oxidant is provided to the kerogen in combination with a carrier fluid, the combination being prepared in surface facilities and passed to the subsurface shale through an injection well. Exemplary carrier fluids include an aqueous fluid, an ethanol fluid or combinations thereof. An ethanol fluid contains ethanol, and typically at least 30 wt. % ethanol, such as from 30 wt. % to 100 wt. % ethanol. The ethanol fluid may also contain water. Likewise, the aqueous fluid may contain ethanol. In one embodiment, the carrier fluid encompasses a concentration range from 100 wt. % water to 100 wt. % ethanol, or any combination between.

The carrier fluid generally contains sufficient oxidant to facilitate the production of organic acids from the kerogen in a desired time frame. Higher concentrations of the oxidant generally results in faster reaction rates. In one embodiment, the carrier fluid contains from 0.1 wt. % to 40 wt. % of the oxidant; in another embodiments from 0.1 wt. % to 25 wt. %; in another embodiment from 1 wt. % to 15 wt. %.

The carrier fluid is prepared at a pH that is suited for the particular oxidant used. In one embodiment, the carrier fluid has a pH in the range from 7 to 14; in another embodiment in the range from 7 to 9; in another embodiment in the range from 1.5 to 6.5. Alkaline materials, inorganic acids, organic acids and $CO_2$ are suitable reagents for the preparation of the carrier fluid at different pH levels.

In one embodiment, the carrier fluid comprises an organic solvent. Illustrative organic solvents that are suitable include refinery streams boiling in the range from 100° C. to 500° C.; $C_4$ to $C_{21}$ hydrocarbons, including naphtha, diesel fuel, and gas oils; alcohols, including methanol, ethanol, propanol, butanol; aromatics, including benzene, toluene, the xylenes and alkyl substituted variations thereof ethers; ketones; esters; tetralin; n-methyl-2-pyrrolidone; tetrahydrofuran; and 2-methyl-tetrahydrofuran. In one embodiment, the formation fluid includes a mixture of an aqueous solvent and an organic solvent, in any proportion.

Reactive Fluid

In one embodiment, the process includes contacting the kerogen in the subsurface shale with a permanganate oxidant to form organic acids. The permanganate may be supplied to the kerogen from surface facilities, either in solid form or as a solution. When supplied in aqueous or ethanol solution, sufficient permanganate is provided to react with kerogen at a temperature in the range of 0° C. to 200° C. to form organic acids. The permanganate solution may contain up to the solubility limit of the permanganate at formation temperatures. In one embodiment, the permanganate solution contains in the range from 0.1 wt. % to 40 wt. % permanganate, or in the range from 0.1 wt. % to 25 wt. % permanganate, or in the range from 1.0 wt. % to 15 wt. % permanganate, expressed in terms of the weight of anhydrous permanganate salt dissolved in a given weight of solution. With ethanol solutions, the ethanol may be the only solvent, or it may be used as a co-solvent in the solution. The permanganate may be any soluble permanganate-containing material. Ammonium permanganate, $NH_4MnO_4$; calcium permanganate, $Ca(MnO_4)_2$; potassium permanganate, $KMnO_4$; and sodium permanganate, $NaMnO_4$ are suitable permanganates for the process.

A permanganate solution supplied to the kerogen may be tailored to complement chemical features of the oil shale formation, or the chemical features of a formation fluid, if present in the formation. In one embodiment, the permanganate solution has a pH of at least 7, or in the pH range of from 7 to 9. In some such embodiments, the desired permanganate solution pH is achieved with the addition of an alkaline material. Exemplary alkaline materials which are useful include, for example at least one of carbonates, bicarbonates, oxides, and hydroxides of, for example, sodium, potassium, calcium, and magnesium. An illustrative extractive fluid contains a molar ratio of carbonate to bicarbonate in the range from 5:95 to 95:5; or in the range from 10:90 to 90:10; or in the range from 25:75 to 75:25.

In the process, the permanganate oxidant in contact with the kerogen forms organic acids and manganese oxides as reduced forms of the manganese oxidant, including reduced forms such as $MnO_2$, $Mn^{2+}$ and $MnO_4^-$.

In one embodiment, a surfactant or mixture of surfactants are provided to the kerogen in the subsurface shale. The surfactant can be any substance that reduces surface tension of the fluid, or reduces interfacial tension between two liquids, or one liquid and the surrounding formation. The surfactant can also be chosen, for example, to increase the accessibility of the fluid to the kerogen, and/or to increase the mobility of the reaction products from the kerogen, and/or to increase the effectiveness of the fluid for absorbing the reaction products. Suitable surfactants for use in the present fluids may be selected from nonionic, anionic or amphoteric surfactants.

In one embodiment, the permanganate oxidant is combined with a solvent or carrier fluid to form a reactive fluid for passing to the kerogen in the subsurface shale formation. The reactive fluid is designed and formulated to provide oxidant to the formation fluid, and to maintain the integrity of the oxidant until it is in contact with the kerogen. In one embodiment, the reactive fluid is further formulated to mobilize organic acids, which are formed during kerogen conversion, either as a suspension of colloidal kerogen fragments or as a solution of dissolved organic acids.

The reactive fluid includes a carrier fluid that may be either an aqueous solvent, or an organic solvent, or combinations thereof. The carrier fluid may be provided from any suitable source, such as, for example, one or more of municipal water; surface water or water from a subsurface aquifer; bitter water sources with high pH levels, and containing quantities of one or more of carbonates, bicarbonates, oxides, and hydroxides, which are recovered from subsurface aquifers; reactive water; and recycle aqueous fluids from the kerogen conversion and extraction process. In one embodiment, the recycle aqueous fluid contains organic acids which remain in solution following the step of isolating at least a portion of the organic acids from the mobile kerogen-based product. In one embodiment, the recycle aqueous fluid contains organic acids from the isolating step that are added back to the recycle aqueous fluid as surfactants. In one such embodiment, the recycle aqueous fluid contains at least 0.1 wt. % organic acids, including, for example, at least 0.5 wt. % organic acids; or at least 1.0 wt. % organic acids.

At least a portion of the reactive fluid may be prepared in surface facilities. It may be desirable to locate the preparation of the aqueous reactive fluid such that the prepared fluid is conducted by pipeline transport from the preparation location to the injection well for providing the fluid to the subsurface shale.

The permanganate oxidant concentration in the reactive fluid is determined by a number of factors, including the stability and reactivity of the oxidant at the conditions of the subsurface formation, the nature of the inorganic component of the subsurface shale, and the desired products from the kerogen conversion reactions. In one embodiment, the oxidant concentration in the reactive fluid is kept at a low level to reduce the secondary oxidation reactions of the organic acids which have been liberated from the kerogen. In one embodiment, the reactive fluid as provided to the subsurface shale formation contains in the range from 0.1 wt. % to 100 wt. % oxidant; or in the range from 0.1 wt. % to 40 wt. % oxidant; or in the range of 0.1 wt. % to 25 wt. % oxidant, or in the range from 1 wt. % to 15 wt. %. In one embodiment, the reactive fluid contains from 0.1 wt. % to 40 wt. % of the oxidant in a carrier fluid selected from the group consisting of an aqueous fluid, an ethanol fluid or combinations thereof.

The pH of the reactive fluid containing the permanganate oxidant has a pH in a range from 7 to 14; in one embodiment, from 7 to 9. Achieving the desired pH may include the addition of an alkaline material to the reactive solution. Exemplary alkaline materials which are useful include, for example at least one alkaline material selected from carbonates, bicarbonates, oxides, and hydroxides of, for example, sodium, potassium, calcium, and magnesium. An illustrative reactive fluid contains a molar ratio of carbonate to bicarbonate in the range from 5:95 to 95:5; or in the range from 10:90 to 90:10; or in the range from 25:75 to 75:25.

In one embodiment, the reactive fluid comprises a surfactant or mixture of surfactants for provision to the kerogen in the subsurface shale. The surfactant can be any substance that reduces surface tension of the fluid, or reduces interfacial tension between two liquids, or one liquid and the surrounding formation. The surfactant can also be chosen, for example, to increase the accessibility of the fluid to the kerogen, and/or to increase the mobility of the reaction products from the kerogen, and/or to increase the effectiveness of the fluid for absorbing the reaction products. Suitable surfactants for use in the present fluids may be selected from nonionic, anionic or amphoteric surfactants.

In one embodiment, the reactive fluid contains a catalyst or a catalyst precursor, which includes one or more metals which have activity for the catalytic conversion of carbonaceous material. A catalyst precursor may have activity for catalyst conversion reactions of the kerogen. Catalysts can also be used in preconditioning prior to or during initial use of oxidants to improve its catalytic activity, selectivity, or some other measure of catalyst performance as a catalyst. Any known catalytic metal is suitable as a component of the reactive fluid.

In one embodiment, the catalyst or catalyst precursor includes a metal selected from the group consisting of magnesium, calcium, vanadium, chromium, molybdenum, manganese, iron, cobalt, nickel, palladium, platinum, copper, zinc, aluminum, and silicon. In the process, the metal can be a transition metal. In certain embodiments, suitable metals include Group VI metals, Group VIII metals, and coinage metals. Group VI metals refer to any one or more of chromium, molybdenum, and tungsten. Group VIII metals refer to any noble or non-noble Group VIII metal, including any one or more of iron, ruthenium, osmium, hassium, cobalt, rhodium, iridium, nickel, palladium, and platinum. Coinage metals refer to any one or more of copper, silver, and gold.

The metal can be in the form of ionic metal, complexed metal, or encapsulated metal. Ionic metals are metals in their positive oxidation states, for example $Ni^{2+}$, $Ni^{1+}$, $Mo^{2+}$, $Cu^{2+}$, $Cu^{3+}$, $Fe^{2+}$, $Fe^{3+}$. A complexed metal is a chemical species consisting of a metal atom or ion bonded to surrounding molecules or ions. Various ligands or complexing agents may surround the metal atom, typically these are organic ligands. Complexed metals include, for example, iron polysaccharides and iron amino acid chelates. An encapsulated metal is a metal enclosed by a protective coating, shell, or membrane.

When dissolved as a salt or organometallic complex in the reactive fluid, the concentration of the catalyst or catalyst precursor in the reactive fluid is sufficiently high that the solution finds motivation for entering the subsurface shale in response to the applied electrokinetic potential. The electrokinetic potential can be used to induce the fluid comprising metal to access all surface area of the kerogen accessible to a fluid and to deposit the metal on and/or adhere to the surface of the kerogen. The metal particulate catalysts can catalyze reactions creating mobile kerogen-based products.

In the process, the catalyst or catalyst precursor are introduced into the subsurface shale formation to facilitate the conversion of kerogen to kerogen conversion products. In one embodiment, the kerogen conversion products include organic acids, and the conversion mechanism if by oxidation. With an oxidation mechanism, an oxidant is supplied to the kerogen.

In another embodiment, the kerogen conversion products include hydrocarbons such as paraffins, olefins and aromatics, and the conversion mechanism is by hydrogenation, by hydrotreating, by hydrocracking, or by saturation. Using such mechanisms also generally requires the presence of a reducing agent. Suitable reducing agents include hydrogen, hydrazine, sodium borohydride (NaBH4), hydrogen donor solvents, and mixtures thereof. Processes of this type are disclosed in U U.S. application Ser. No. 13/335,290 (US Patent Publication No. US 2013-0161008), entitled "Preparation and use of Nano-Catalysts for In-Situ Reaction with Kerogen", filed Dec. 22, 2011, the entire disclosure of which is incorporated herein by reference.

In one embodiment, the reactive fluid further comprises at least one phase transfer catalyst to enhance the chemical interaction between kerogen and oxidant, for increasing the reaction rate of the oxidant. In one such embodiment, the phase transfer catalyst is selected from the group consisting of tetraethyl ammonium chloride and the crown ether 1,4,7,10,13,16-hexaoxacyclooctadecane (18-crown-6 crown ether).

In the process, the reactive fluid that includes the oxidant is caused to flow from an injection well to a kerogen rich zone in the subsurface shale using electrokinetics.

Referring to FIG. 1, subsurface shale formation 10 includes subsurface shale, which includes kerogen rich zone 11. Injection well 13 extends into the kerogen rich zone 11 of subsurface shale formation 10 such that injection well 13 is in fluid communication with the kerogen rich zone 11. Subsurface shale formation 10 can be any type of subsurface formation in which hydrocarbons are stored, such as limestone, dolomite, oil shale, sandstone, or a combination thereof. Production well 15 is also in fluid communication with the kerogen rich zone 11 of the subsurface shale formation 10 in order to receive hydrocarbons therefrom. Production well 15 is positioned a predetermined lateral distance away from injection well 13. For example, production well 15 can be positioned between 100 feet to 10,000 feet away from injection well 13. As will be readily appreciated by those skilled in the art, there can be additional injection wells 13 and production wells 15, such that production wells 15 are spaced apart from injection wells 13 at predetermined locations to optimally receive the hydrocarbons being pushed due to injections from injection wells 13 through kerogen rich zone 11 of subsurface shale formation 10. Furthermore, while not shown in FIG. 1, injection well 13 and production well 15 can deviate from the vertical position such that in some embodiments, injection well 13 and/or production well 15 can be a directional well, horizontal well, or a multilateral well.

As will be described in further detail below, in operation, an oxidant or a reactive fluid containing an oxidant 17 is injected into kerogen rich zone 11 of subsurface shale formation 10 through injection well 13. The reactive fluid 17 comprises a polar fluid or a fluid having a net total charge. For example, reactive fluid 17 can be water based as it has an uneven distribution of electron density and therefore, comprises a polar molecule. In one or more embodiments, reactive fluid 17 comprises a polar gas. In one or more embodiments, reactive fluid 17 comprises a chemical or mixture of chemicals having a net total charge.

In some embodiments, reactive fluid 17 alters the physical properties of the formation or rock matrix of kerogen rich zone 11 such as by increasing the effective porosity and permeability of the matrix so that the hydrocarbons are more accessible and recoverable. For example, oil shale often contains large amounts of tightly bonded carbonates and pyrites that can be dissolved using acid. Depletion of these carbonate minerals from the shale matrix, such as through bioleaching, results in newly formed cavities that effectively increases the porosity (e.g., from less than 0.5% to about 4 or 5%) and permeability of the oil shale, thereby enhancing recovery of the hydrocarbons. In some embodiments, reactive fluid 17 penetrates into pore spaces of the formation contacting the trapped oil globules such that the oil trapped in the pore spaces of the reservoir rock matrix is released. For example, reactive fluid 17 can include a surface active agent reducing the interfacial tension between the water and oil in the subsurface shale formation such that the oil trapped in the pore spaces of the reservoir rock matrix is released.

Referring to FIG. 1, an electric field is generated through at least a portion of the kerogen rich zone 11 to induce electrokinetic migration of reactive fluid 17. Electrokinetic induced migration allows for the reactive fluid 17 to contact portions of the reservoir that previously were unswept due to the limitations of traditional hydraulic injection, thereby enhancing recovery of hydrocarbons from kerogen rich zone 11 of subsurface shale formation 10 through production well 15. The electric field is generated by electrodes that impose a low voltage direct current through at least the portion of the kerogen rich zone 11 between injection well 13 and production well 15.

In one embodiment, one or more electrodes are placed in communication with injection well 13 such that the electrically charged injection well acts as either an anode or a cathode. Similarly, one or more electrodes are placed in communication with production well 15 such that the electrically charged production well acts as an opposing cathode or anode to injection well 13. The respective charges create an electric current in the reservoir fluids contained within kerogen rich zone 11 of subsurface shale formation 10, which induces electrokinetic migration of reactive fluid 17 such that it is distributed within kerogen rich zone 11 of subsurface shale formation 10. One skilled in the art will appreciate that additional electrodes can be placed in locations other than in communication with injection well 13 and production well 15, such that an electric field is created that is capable of directing reactive fluid 17 to a plurality of areas of within subsurface shale formation 10. In some embodiments, the electrodes are positioned directly within the kerogen rich zone 11. In some embodiments, the electrodes are positioned at locations above or below kerogen rich zone 11 such as within rock layers adjacent to kerogen rich zone 11.

The electrodes can be made of any conductive material such as carbon or graphite. Electrodes of carbon and graphite are generally more resistant to corrosion. In another embodiment, the electrodes are conductive polymeric materials or intrinsically conducting polymers (ICPs), which also inhibit corrosion. In one embodiment, the electrodes create a low voltage direct current of less than about 10 volts per meter (V/m). In another embodiment, the electrodes create a low voltage direct current of less than about 20 volts per meter (V/m). In another embodiment, the electrodes create a low voltage direct current of less than about 50 volts per meter (V/m). In some embodiments, the low voltage direct current is periodically pulsed or reversed, which can help prevent buildup of acidic conditions at the cathode. In one embodiment, the frequency of pulsing and/or reversal of polarity is less than about a second. In another embodiment, the frequency of pulsing and/or reversal of polarity is greater than about a minute, such as ranging from periods of minutes to days.

Figure 2:
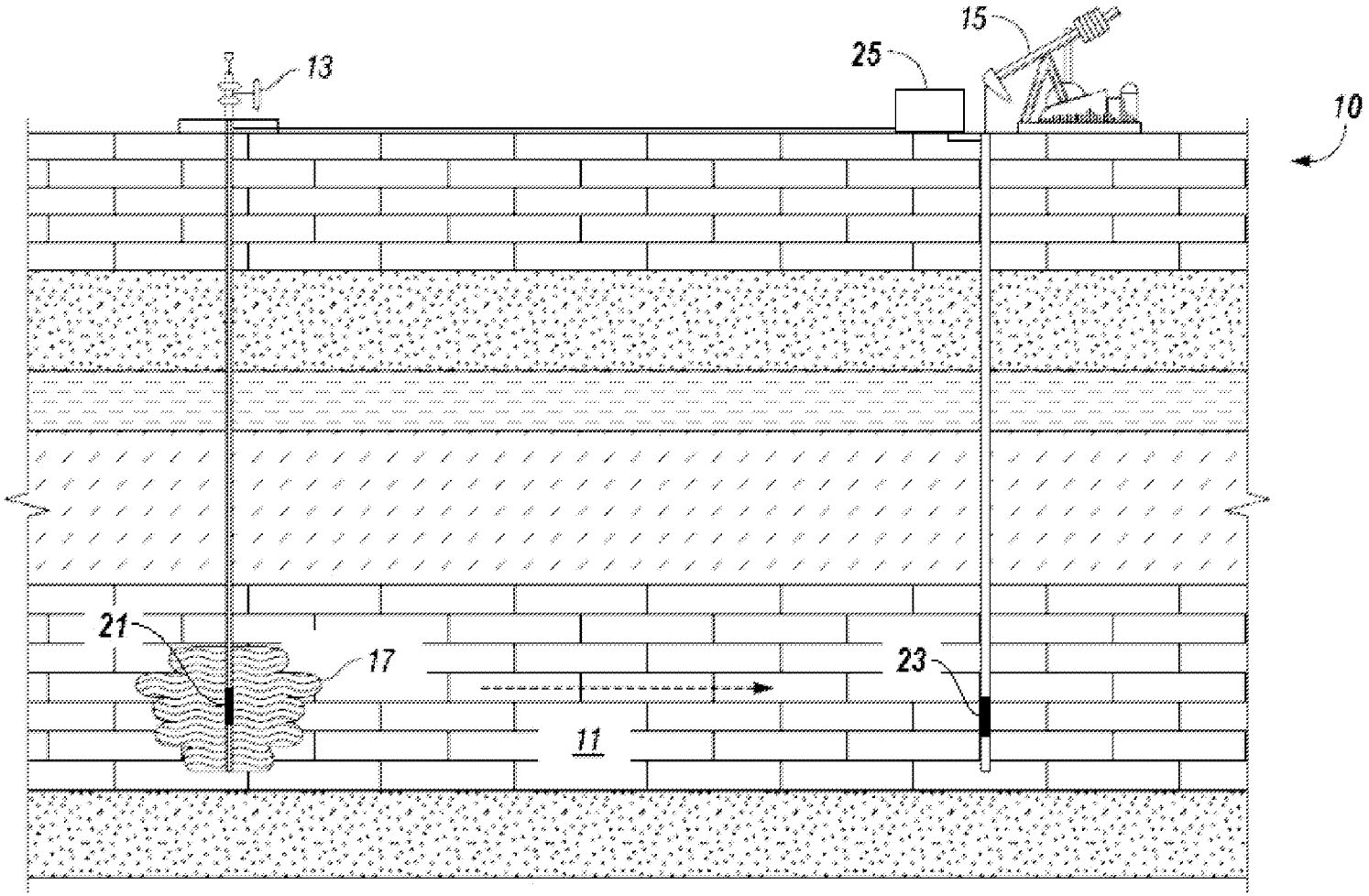
FIG. 2 is a schematic sectional view of an example oil recovery system that includes a reservoir that is in fluid communication with an injection well and a production well equipped with a pair of electrodes during enhanced oil recovery operations, in accordance with an embodiment of the present invention.

FIG. 2 shows an embodiment of the present invention in which injection well 13 and production well 15 are equipped with a pair of electrodes 21, 23, respectively. A power source 25 is provided such that the positive and negative terminals are connected to electrodes 21, 23. The size of the power source is dependent on the size and characteristics of the reservoir. The size of the power source is however, large enough to sufficiently produce a low voltage direct current through at least a portion of the kerogen rich zone 11. In one embodiment, the positive terminal of power source 25 is in communication with electrode 21 such that electrode 21, which is coupled to injection well 13, acts as an anode. The negative terminal of power source 25 is in communication with electrode 23 such that electrode 23, which is coupled to production well 15, acts as a cathode. In another embodiment, the positive and negative terminals of the power source 25 are switched such that the positive terminal of power source 25 is in communication with electrode 23 and the negative terminal of power source 25 is in communication with electrode 21. Here, injection well 13 acts as the cathode and production well 15 acts as the anode. In either embodiment, the pair of electrodes 21, 23 generates an electric field through at least a portion of the kerogen rich zone 11 to induce electrokinetic migration of reactive fluid 17. In other embodiments (not shown in FIG. 2), electrodes 21, 23 are positioned in locations other than being coupled to injection well 13 and production well 15. The electrodes can also be positioned at locations above or below kerogen rich zone 11 such as within rock layers adjacent to kerogen rich zone 11. Additionally, a plurality of electrodes can be interspersed within subsurface shale formation 10 such that an electric field is created to drive reactive fluid 17 to unswept areas within kerogen rich zone 11.

Therefore, embodiments of the present invention utilize electrokinetic-induced migration to overcome the fluid channeling limitations related to traditional hydraulic injection. In particular, a low voltage direct current is used to move or distribute reactive fluid 17 within the saturated porous media of the reservoir. For example, polar fluids or fluids having a net charge, including water, gas, surfactants, dissolved species, colloids, and micelles, can be moved rapidly through porous media under the influence of a direct current. In general, the rate of movement is associated with the power output of the power source, porosity of the reservoir matrix, and charge density. Further, the rate of migration of the reactive fluid 17 is independent of the hydraulic conductivity. Accordingly, as reactive fluid 17 migrates through the subsurface shale formation the rate of movement is independent of the permeability and connectivity of the porous rock matrix. For example, reactive fluid 17 under electrokinetics migration can penetrate through rocks having a very small porosity, such as a porosity of 0.02% or less. Reactive fluid 17 is therefore distributed to portions of the subsurface shale formation where trapped oil is located, such as those areas where traditional enhanced oil recovery floods have not swept. One skilled in the art will recognize that this is advantageous as injected reactive fluid 17, such as water during an induced water flood, can be mobilized from one portion of the reservoir where oil saturations are low into another portion of the reservoir where oil saturations are high.

In one embodiment, reactive fluid 17 penetrates into pore spaces of the formation contacting the trapped oil globules such that the oil trapped in the pore spaces of the reservoir rock matrix is released by reducing the interfacial tension between the water and oil in the subsurface shale formation. For example, reactive fluid 17 can comprise at least one surfactant or a component that will produce at least one surfactant in situ having a net total charge. Reactive fluid 17 can produce naturally occurring surfactants, such as from a biologically mediated reaction. Alternatively, reactive fluid 17 can produce surfactant in situ as a by-product of an induced process. For example, one or more compounds can be injected into the reservoir such that they react with reservoir materials to produce a surfactant. In another embodiment, one or more compounds can be injected into the reservoir that when mixed in the rock matrix react with each other to produce surfactant. Examples of surfactants that can be utilized for as or in reactive fluid 17 include anionic surfactants, cationic surfactants, amphoteric surfactants, non-ionic surfactants, and a combination thereof. As a skilled artisan may appreciate, the surfactant(s) selection may vary depending upon such factors as salinity and clay content in the reservoir. The surfactants can be injected in any manner such as in an aqueous solution, a surfactant-polymer (SP) flood or an alkaline-surfactant-polymer (ASP) flood. The surfactants can be injected continuously or in a batch process.

Reactive fluid 17 can comprise anionic surfactants such as sulfates, sulfonates, phosphates, or carboxylates. Such anionic surfactants are known and described in the art in, for example, SPE 129907 and U.S. Pat. No. 7,770,641, which are both incorporated herein by reference. Example cationic surfactants include primary, secondary, or tertiary amines, or quaternary ammonium cations. Example amphoteric surfactants include cationic surfactants that are linked to a terminal sulfonate or carboxylate group. Example non-ionic surfactants include alcohol alkoxylates such as alkylaryl alkoxy alcohols or alkyl alkoxy alcohols. Currently available alkoxylated alcohols include Lutensol® TDA 10EO and Lutensol® OP40, which are manufactured by BASF SE headquartered in Rhineland-Palatinate, Germany. Neodol 25, which is manufactured by Shell Chemical Company, is also a currently available alkoxylated alcohol. Chevron Oronite Company LLC, a subsidiary of Chevron Corporation, also manufactures alkoxylated alcohols such as L24-12 and L14-12, which are twelve-mole ethoxylates of linear carbon chain alcohols. Other non-ionic surfactants can include alkyl alkoxylated esters and alkyl polyglycosides. In some embodiments, multiple non-ionic surfactants such as non-ionic alcohols or non-ionic esters are combined. The surfactant(s) of reactive fluid 17 can be any combination or individual anionic, cationic, amphoteric, or non-ionic surfactant so long as reactive fluid 17 has a net total charge.

In one embodiment, electrokinetics is utilized for environmental treatment of wastes (ex situ and/or in situ). In particular, electrokinetics can enhance chemical treatment of contaminated soil or sediment. The contaminant may be organic, such as oil or solvent, or inorganic, such as mercury and arsenic. The reactive fluid can include a surfactant that reduces the interfacial tension between oil and water, thereby increasing the solubility of the contaminant.

Applications of electrokinetic-induced migration are illustrated in U.S. Pat. No. 7,547,160 and in "Electrokinetic Migration of Permanganate through Low-Permeability Media," by D. A. Reynolds et al., Ground Water, July-August 2008, 46 (4), pp. 629-37, which are both incorporated herein by reference. These publications illustrate rapid electrokinetic-induced migration of an oxidant (potassium permanganate) through low permeability clay material. In particular, the oxidant is delivered through the low permeability clay material at orders of magnitude faster than that of hydraulically induced flow.

For example, the advantages of electrokinetic-induced migration over traditional hydraulic delivery is illustrated in the following experiment. A thin glass tank having a width of about 4 cm was constructed to simulate a two-dimensional flow field through a heterogeneous porous media. House-brick sized pieces of clay, which represent low permeability features, were emplaced within a zone of contiguous glass beads. The glass beads represent the high permeability zones of channeled flow. The tank was saturated with water and a flow field was established across the apparatus by fixing the hydraulic head (water elevation) at different heights on either side of the tank. Potassium permanganate was introduced into one side of the tank and allowed to flow through the apparatus. The potassium permanganate was substantially distributed within the glass beads after two hours. However, essentially no infiltration into the clay bricks occurred, indicating that the potassium permanganate bypassed the low permeability zones. This experiment was repeated, however, an anode and cathode were placed at either end of the tank after the potassium permanganate had flowed through the apparatus for two hours. A low voltage direct current of approximately 10 volts per meter (V/m) was applied between the anode and cathode for 20 minutes. The clay blocks were dissected and showed that the potassium permanganate fully penetrated the clay bricks.

Application of electrokinetic induced migration to enhance the distribution of a reactive fluid is disclosed. Use of electrokinetic induced migration allows for the reactive fluid to contact portions of the reservoir that previously were unswept due to the limitations of traditional hydraulic injection. In some embodiments, the reactive fluid further penetrates into pore spaces of the formation contacting the trapped oil globules, thereby reducing the interfacial tension between the water and oil in the reservoir and releasing the oil from the pore spaces.

Formation Fluid

In the process, kerogen in subsurface shale is contacted with the permanganate oxidant. In one embodiment, the oxidant contacts the kerogen in the subsurface shale in liquid medium, otherwise termed a "formation fluid". The kerogen in the subsurface shale can also be contacted with a catalyst and the catalyst can contact the kerogen in liquid medium, "formation fluid". In this case, at least a portion of the liquid medium may be the reactive fluid that is prepared in surface facilities and passed to the subsurface shale through an injection well. Likewise, at least a portion of the liquid medium may be formation water that is naturally occurring in the subsurface shale.

Reaction conditions and the composition of the formation fluid for converting kerogen into the mobile kerogen-based product are selected to minimize the environmental effects of the process for extracting the kerogen-based product; and/or to maximize the conversion of kerogen into the mobile kerogen-based product. Reaction conditions and composition of the formation fluid can also be selected to maximize the selectivity of reaction to $C_{10}$+ organic acids and/or to minimize the conversion of the kerogen to $CO_2$.

The step of contacting the kerogen with the formation fluid in the subsurface shale is generally conducted at or near a natural formation temperature. In one embodiment, the contacting occurs at a temperature in the range of between 0° C. and 200° C. In one embodiment, the contacting occurs at a temperature of less than 200° C. above the natural formation temperature. In one embodiment, the contacting occurs at a temperature below a pyrolysis temperature of the kerogen. In one such embodiment, the contacting occurs at a temperature in one the following ranges: between 10° C. and 150° C.; between 20° C. and 100° C.; or between 25° C. and 75° C. In one such embodiment, the formation fluid contacts the kerogen at a temperature of less than 150° C.; or less than 100° C.; or even less than 75° C. above the natural formation temperature. In a non-limiting specific example, the contacting is conducted at a temperature of less than 50° C. above the natural formation temperature. In one embodiment, the contacting is conducted under conditions in which no added heat is supplied to the formation fluid and/or to the subsurface shale in contact with the formation fluid. In one embodiment, if heat is supplied during the kerogen conversion to meet the above-mention target temperature, it is supplied solely from exothermic chemical processes within the kerogen and/or within the subsurface shale in contact with the kerogen. As such, no external heating is provided. The contacting occurs at temperature below pyrolysis temperature of the kerogen.

Generally, the kerogen in the subsurface shale is contacted with the formation fluid at or above natural formation pressure (i.e., the pressure of the subsurface shale formation in the region that includes the kerogen), so as to maintain or increase the accessibility of the fluids to kerogen in the subsurface shale formation. In one such embodiment, the formation fluid is provided to the formation at a pressure above fracture pressure, so as to increase the accessibility of the formation fluid to the kerogen in the formation. Methods for determining the formation pressure and the formation fracture pressure are known. In one such embodiment, the formation fluid is provided to the formation at a pressure of up to 1000 psig; or up to 750 psig; or up to 500 psig; or even up to 250 psig above the natural formation pressure. The natural formation pressure, as used herein, is the pressure of the subsurface shale formation, in the region of the kerogen, prior to human intervention with or in the formation. Methods for determining natural formation pressure are known.

In one embodiment, the process includes contacting the kerogen in the subsurface shale with an oxidant. The mobile kerogen-based product comprises reaction products from the reaction of the oxidant with the kerogen. In one embodiment, the process includes contacting the kerogen in the subsurface shale with a catalyst. The mobile kerogen-based product comprises reaction products from the reaction of the catalyst with the kerogen. The step of creating a mobile kerogen-based product involves a chemical modification of the kerogen. The chemical modification involves at least some cracking of the kerogen, generating smaller kerogen-derived molecules that are correspondingly more mobile.

In one embodiment, a fluid, such as a formation fluid in contact with the kerogen, facilitates the kerogen reactions. The formation fluid may be caused to flow through the subsurface shale formation for an amount of time needed to reach a certain objective, e.g., a reduced oxidant concentration target in the formation fluid, or a target amount of mobile reaction products produced, or a target extent of conversion of the kerogen. The formation fluid may then be caused to flow through the subsurface shale formation for an amount of time need to reach a certain objective, e.g., a target removal of mobile reaction products, or a target concentration of mobile reaction products in the formation fluid. In another embodiment, the process of providing reactive fluid to the kerogen may be a cyclic process, repeated until a target level of kerogen conversion is achieved. In another embodiment, a formation fluid is suitable for both converting kerogen in the subsurface shale and absorbing the reaction products to form the mobile kerogen-based product, which is recovered for isolating the organic acids contained therein.

In one embodiment, pumping is used to transport the mobile kerogen-based product out of the subsurface shale formation, wherein such pumping can be performed using techniques known to those of skill in the art. Conventional oil field practices (both flowing gas and pumping fluids, e.g., rod pumps, electrical submersible pumps, progressive cavity pumps, etc.) can be modified to provide reliability in a given producing environment. For example, modifications may require changes in metallurgy, pressure limitations, elastomeric compositions, temperature rating, and the like.

Production could use any standard producing process such as, but not limited to, at least one well penetrating into the subsurface shale formation as an injection well for providing fluids to the subsurface shale formation and at least one well penetrating into the subsurface shale formation as a production well for producing fluids from the formation, Huff-n-Puff (i.e., a single well is used as both the producer and injector), water flooding, steam flooding, polymer flooding, solvent extraction flooding, thermal processes, diluent addition, steam assisted gravity drainage (SAGD), and the like.

The formation fluid is a fluid, such as an aqueous fluid, which is in contact with the kerogen in the subsurface shale formation. In one embodiment, at least a portion of the formation fluid is supplied as a reactive fluid from surface facilities. In one embodiment, the reactive solution provided to the kerogen establishes a formation fluid in contact with the kerogen, or it supplements a formation fluid which is already established, or which is naturally occurring in the subsurface shale formation in contact with the kerogen. In one embodiment, the formation fluid is derived from, or results from, formation water that naturally occurs within the formation. The formation fluid may be present and in contact with the kerogen in the formation, in small quantities which merely wet the solid surfaces in the formation. Alternatively, the formation fluid may be present in sufficient quantities to flood the formation; or in any quantity between the wetted or flooded states.

The formation fluid is any fluid (including mixtures) that can, either by itself, with an agent combined with the fluid, or in combination with a solvent, chemically modify the kerogen so as to render it mobile and therefore extractible. In one embodiment, the formation fluid comprises an oxidant having a chemical property of oxidation. In one aspect, the oxidant is active for breaking chemical bonds in kerogen. In one aspect, the oxidant is active for breaking carbon-oxygen bonds in kerogen. In one aspect, the oxidant is active for breaking carbon-carbon double bonds in kerogen. In one aspect, the oxidant has a low activity for breaking carbon-carbon single bonds in kerogen. In one aspect, the oxidant is active for producing mobile reaction products from kerogen. In one aspect, the oxidant is active for facilitating the mobilization of hydrocarbons from kerogen in subsurface shale. In one embodiment, the formation fluid comprises a catalyst. In one aspect, the catalyst is active for breaking chemical bonds in kerogen.

In one embodiment, at least a portion of the aqueous formation fluid is recovered as a naturally occurring aqueous basic solution from one or more subsurface aquifers; at least a portion of the naturally occurring aqueous basic solution may occur with the subsurface shale. Suitable naturally occurring aqueous basic solutions have a pH of at least 7; or at least 8; or at least 8.5; or in the range of between 7 and 14. In one such embodiment, the naturally occurring aqueous basic solution floods the subsurface shale and is available for absorbing the converted products, or is caused to flow from its source to the subsurface shale that contains the converted products. In another such embodiment, the naturally occurring aqueous basic solution is recovered from the aquifer through a well drilled into the aquifer. The recovered solution, optionally with added components, such as added carbonates, bicarbonates, oxides and/or hydroxides and/or added surfactants, is passed through an injection well into the subsurface shale resource for extracting the hydrocarbon products present therein.

In one embodiment, at least a portion of the alkaline materials, including one or more of carbonates and bicarbonates and oxides and hydroxides, that are present in the formation fluid are derived from naturally occurring deposits. Naturally occurring sources of the alkaline materials are known. The following carbonate and bicarbonate minerals are non-limiting examples.

- Sodium sesquicarbonate ($Na_3H(CO_3)_2$) is either a double salt of sodium bicarbonate and sodium carbonate, or an equimolar mixture of those two salts, with varying quantities of water of hydration.
- The dihydrate, $Na_3H(CO_3)_2.2H_2O$, occurs in nature as mineral trona.
- Thermonatrite is a naturally occurring mineral form of sodium carbonate $Na_2CO_3.(H_2O)$.
- Natron is a naturally occurring mixture of sodium carbonate decahydrate ($Na_2CO_3.10H_2O$) and sodium bicarbonate ($NaHCO_3$), often with relatively minor quantities of sodium chloride and sodium sulfate.
- Nahcolite is a naturally occurring form of sodium bicarbonate ($NaHCO_3$).
- Shortite is a naturally occurring form of a sodium-calcium carbonate mineral ($Na_2Ca_2(CO_3)_3$).

As a non-limiting illustrative example, a reactive fluid is passed, via an injection well, to a source of the alkaline materials within or near the subsurface shale resource to dissolve the alkaline materials into the formation fluid before being passed to the formation fluid in the subsurface shale formation. In some cases, liquid water is injected under sufficient pressure into the carbonate and/or bicarbonate source to cause the water to wet at least a portion of the source and to dissolve at least some of the carbonate and/or bicarbonate into the water.

In one such embodiment, the water that contains the dissolved alkaline materials is caused to flow from the deposit in which it occurs to the subsurface shale resource that contains the converted hydrocarbon products. In another such embodiment, the solution of the dissolved alkaline materials is recovered from the aquifer through a well drilled into the aquifer. The recovered solution, optionally with added components, such as added carbonates, bicarbonates, oxides and/or hydroxides, or added surfactants, is passed through an injection well into the subsurface shale resource for extracting the hydrocarbon products present therein.

In another such embodiment, at least a portion of the water is introduced to the deposit of alkaline materials as steam, and in some cases as superheated steam, to facilitate the dissolution of the alkaline materials into the water. At least some of the steam condenses, dissolves the alkaline materials, and is passed to the subsurface shale formation.

In one such embodiment, the process includes contacting the kerogen with the fresh formation fluid, and producing a spent formation fluid which contains less than 20 wt. %, or less than 10 wt. %, or less than 5 wt. % of the oxidant, or less than 1 wt. % of the oxidant, or less than 0.5 wt. % of the oxidant, or less than 0.1 wt. % of the oxidant. In one embodiment, the reactivity of the formation fluid is enhanced by addition of a combination of oxidants.

The formation fluid has a pH that is generally selected to balance the stability, reactivity and solubility of the oxidant in the formation fluid with the solubility and stability of the kerogen reaction products in the formation fluid. Oxidants that exhibit high kerogen conversion activity in aqueous fluid at pH values of at least 7 are generally supplied to the subsurface shale formation in a basic solution (i.e., basic formation fluid). In one such embodiment, the desired reactive solution pH is achieved with the addition of an alkaline material to the reactive solution. Exemplary alkaline materials which are useful include, for example at least one alkaline material selected from carbonates, bicarbonates, oxides, and hydroxides of, for example, sodium, potassium, calcium, and magnesium. An illustrative formation fluid contains a molar ratio of carbonate to bicarbonate in the range from 5:95 to 95:5; or in the range from 10:90 to 90:10; or in the range from 25:75 to 75:25.

The formation fluid may be further treated with acids or bases to tailor the pH of the formation fluid, to, for example, account for the solubility and/or stability of the oxidant or to increase the solubility of the mobile organic acids produced during the kerogen conversion process. In one embodiment, the formation fluid that is supplied to the subsurface shale has a pH of less than or equal to 7, or in the range from 1.5 to 6.5. In another embodiment, the formation fluid that is supplied to the subsurface shale has a pH of at least 7. In this case, the pH of the formation fluid is selected both to facilitate the solubility of organic acids in the formation fluid and to facilitate the chemical stability and reactivity of the oxidant at subsurface shale formation conditions. In one embodiment, the formation fluid is supplied to the subsurface shale formation at a pH in the range of 7 to 14; or in the range of 7 to 9.

The formation fluid may further contain other components for, e.g., enhancing the reactivity of the reactive components, for enhancing the accessibility of the formation fluid to the kerogen, or for enhancing the dissolution, absorption, or dispersion of mobile reaction products into the formation fluid.

Formation Water

Formation water, a naturally occurring liquid source within at least some kerogen deposits in subsurface shale, is a suitable source for at least a portion of the formation fluid used for converting kerogen and recovering useful products. Some kerogen deposits are directly in contact with formation water. Other kerogen deposits are wetted by residual formation water. In other deposits, the formation water aquifer is remote from the kerogen deposit which is being exploited for recovering useful products. When sufficient formation water is present, either in contact with the kerogen or sufficiently near the kerogen deposit to be passed to the kerogen deposit, the formation water may be useful as a source of at least some of the components of the formation fluid.

Certain subsurface shale formations, such as the Green River Shale, are characterized by limestone deposits that produce formation water aquifers having a basic pH (i.e., pH greater than 7). In one embodiment, formation waters are useful as a source or a component of the formation fluid. In an exemplary process, oxidant is provided to formation water to form the formation fluid, which facilitates the conversion of kerogen at a temperature in the range of between 0° C. and 200° C. to form organic acids.

In the case in which the kerogen is naturally in contact with formation water that is suitable for the process, the process includes providing an oxidant to the formation water to produce the formation fluid. For formations in which the formation water having the desired properties is in an aquifer separate from (or remote to) the kerogen, the formation water may be caused to pass from the remote aquifer to the kerogen. This may be achieved, for example, by causing the formation water to pass from the remote aquifer through a borehole which is drilled into the formation water aquifer. In one embodiment, the formation water is passed through the borehole to surface facilities, and processed by addition of oxidant and then provided to the kerogen. In another embodiment, the formation water is passed through the borehole directly to the kerogen in the subsurface shale formation.

When at least a portion of the mobile kerogen-based product is withdrawn from the formation, additional formation fluid in the region of the kerogen is produced by flowing additional formation water to, and contacting, the kerogen in the subsurface shale formation to replace the fluid that was withdrawn. In one embodiment, one or more oxidants are provided to the additional formation water that flows into contact with the kerogen.

As stated, a suitable formation water desirably has a pH of at least 7, or in the range from 7 to 14, or in the range from 12 to 14. In one embodiment, the formation water comprises an alkaline material selected from the group consisting of a carbonate, a bicarbonate, an oxide, and a hydroxide. An exemplary alkaline material is selected from the group consisting of sodium carbonate, sodium bicarbonate, and sodium hydroxide, or mixtures thereof.

In the process, the oxidant contacts the kerogen to form organic acids. The organic acids may be saturated, unsaturated, or polyunsaturated. In one embodiment, at least a portion of the organic acids are branched; the branching functional groups may be paraffinic, olefinic or cyclic. Cyclic branching functional groups may be saturated, unsaturated or aromatic. The organic acids may also contain nitrogen and/or sulfur atoms. In one embodiment, the organic acids are monoacids (a single carboxyl functional group in non-ionized or ionized form per molecular unit), or diacids (two carboxyl functional groups per molecular unit), or triacids (three carboxyl functional groups per molecular unit), or higher. Mobile kerogen fragments, including kerogen fragments having a molecular mass of up to 12,000 to 15,000 Daltons or higher, may have multiple carboxyl functional groups that serve to render these fragments mobile in an aqueous medium. These high molecular weight fragments are generally mobilized in the fluid as a slurry, rather than as a pure solution. Under some conditions, the organic acids are present as salts. An exemplary sodium salt of an organic acid contains the carboxyl function group represented by —COO—Na+.

The molecular weight of the organic acids covers a very wide range, including from low molecular weight acids, such as the monoacid, acetic acid, and the diacid, oxalic acid, to high molecular weight kerogen fragments, having a molecular mass of up to 15,000 daltons or higher, and comprising at least one carboxylic acid functional group. In one embodiment, these kerogen fragments have a lower molecular mass than the naturally occurring kerogen itself, but with the general characteristic chemical and conformational complexity of the kerogen structures from which they are derived. Such high molecular weight acids are soluble in, or otherwise mobile in, high pH solutions, such as solutions having a pH of at least 7.5; or at least 8.0; or at least 8.5; or in the range of between 8.5 and 14. Accordingly, In one embodiment, at least 10 wt. %, or at least 30 wt. %, or at least 50 wt. % of the organic acids in the mobile kerogen-based product is in the $C_{35}$+ range. In one embodiment, at least 20 wt. % of the $C_{35}$+ organic acids has a molecular mass number of greater than 1000 daltons.

In one embodiment, a significant fraction of the organic acids are also in the $C_6$ to $C_{20}$ carbon number range. In one such embodiment, at least 10 wt. % of the organic acids in the mobile kerogen-based product are in the $C_6$ to $C_{20}$ range, or in the $C_6$ to $C_{16}$ range, or in the $C_8$ to $C_{14}$ range or in the $C_8$ to $C_{12}$ range. In one such embodiment, at least 20 wt. % of the $C_{35}$− organic acids is in the $C_8$ to $C_{12}$ range. Maintaining reaction conditions to minimize the amount of oxidation of the kerogen while ensuring that the reaction products are mobile has the benefit of decreased oxidant consumption, minimum formation of carbon dioxide product, and reduced hydrogen consumption during the hydrogenation of the acid products during an upgrading step.

In general, the mobile kerogen-based product contains at least one of the following organic acids and hydrocarbons: monoacids, diacids, branched monoacids, branched diacids, isoprenoid acids, hopanoic acids, gamma keto acids, keto monoacids, keto diacids, and n-alkanes. In the range from 10 wt. % to 90 wt. % of the $C_{35}$− organic acids in the mobile kerogen-based product are monoacids. In one such embodiment, in the range from 10 wt. % to 50 wt. % of the $C_{35}$− organic acids are monoacids. Likewise, in the range from 10 wt. % to 90 wt. % of the $C_{35}$− organic acids in the mobile kerogen-based product are diacids. In one embodiment, at least 30 wt. % of the $C_{35}$− organic acids are diacids. In one such embodiment, in the range from 30 wt. to 90 wt. % of the $C_{35}$− organic acids are diacids. In one embodiment, in the range from 1 wt. % to 30 wt. %, or in the range from 1 wt. % to 20 wt. %, or in the range from 1 wt. % to 10 wt. % of the $C_{35}$− organic acids in the mobile kerogen-based product are gamma keto acids.

Mobile Kerogen-based Product

In one embodiment, the organic acids are mobilized to produce a mobile kerogen-based product. The mobile kerogen-based product generally contains at least 1 wt. % organic acid derived products; or at least 2 wt. % organic acid derived products; or at least 5 wt. % organic acid derived products. In some situations, the organic acid derived products are present in the product at a concentration in the range from 5 wt. % to 50 wt. %; or at a concentration in the range from 10 wt. % to 40 wt. %. The ratio of organic acid derived products to other hydrocarbons in the mobile kerogen-based product will depend on the source of the hydrocarbons, but is expected to range from 10% organic acid derived products to 100 wt. % organic acid derived products.

It is believed that organic acids comprise a significant portion of the kerogen based product formed from reaction of oxidants on the kerogen. However, when the organic acids are mobilized, organic acid reaction products may be involved. As such, mobilization of the organic acids may involve, for example, neutralization, dimerization and esterification of the organic acids.

Thus, in one embodiment, the mobile kerogen-based product may comprise organic acid as organic acids. In one embodiment, the mobile kerogen based product may comprise organic acids as organic acid anionic moieties (RCOO—) or organic acid salts (RCOO— M+). The cation (M+) of the organic acid salts can be cations that are naturally present in the formation, for example, sodium, potassium, calcium and magnesium. In one embodiment, the mobile kerogen based product may comprise organic acids as esters. Exemplary esters include methyl and ethyl esters. In one embodiment, the mobile kerogen-based product may comprise organic acids in a form selected from the group consisting of organic acids, organic acid salts, anionic organic acid moieties, organic acid esters, and mixtures thereof.

In one embodiment, the mobile kerogen-based product may comprise paraffins, including n-paraffins and isoparaffins. These kerogen-based products have a lower molecular mass than the naturally occurring kerogen itself, and with the characteristic chemical and conformational complexity of the kerogen structures from which they are derived.

The mobile kerogen-based product may further include components to facilitate extraction of reaction products from the kerogen. These components may include, for example, one or more of a solvent or solvent mixture; alkaline materials; surfactants; organic and/or inorganic acids; organic and/or inorganic bases; soluble organic compounds such as alcohols, ethers, esters, ketones, aldehydes, and the like. In one embodiment, the mobile kerogen-based product is an aqueous phase fluid containing the organic acid derived products, which are dissolved, dispersed, or suspended in the aqueous phase fluid.

In one embodiment, the organic acid reaction products are mobilized at a pH of at least 7, or at a pH in a range from 7 to 14. The pH of the mobile kerogen-based product into which organic acids are extracted, following conversion of the kerogen, may, under some conditions, have a pH in a range from 7 to 14 by reason of contact with alkaline materials in the subsurface shale. Alternatively, at least a portion of the alkaline materials present in mobile product may be provided from surface facilities. Exemplary alkaline materials which are useful include, for example at least one alkaline material selected from carbonates, bicarbonates, oxides and hydroxides of, for example, sodium, potassium, calcium, and magnesium. In an illustrative process, organic acids are extracted from kerogen in contact with alkaline materials, such that a molar ratio of carbonate to bicarbonate in the range from 5:95 to 95:5; or in the range from 10:90 to 90:10; or in the range from 25:75 to 75:25.

The pH of the mobile fluid in contact with the kerogen, for extracting organic acid reaction products, is tailored for the particular organic acids to be extracted into and absorbed by the mobile product. Low molecular weight acids are soluble in fluids having a pH at or near the neutral range (i.e. a pH in a range from 6 to 8). High molecular weight kerogen fragments may be mobilized as a colloid or slurry in the mobile product at a pH in a range from 12 to 14.

Formation of the mobile kerogen-based product may be facilitated by the presence of one or more organic solvents. Suitable organic solvents are selected to remain in a liquid phase, and to maintain the reaction products in solution, at temperature and pressure conditions within the subsurface shale. In one embodiment, a suitable organic extractant is one in which at least a portion of the organic acids are soluble. Exemplary organic extractants contain aromatic compounds such as benzene, toluene and xylene; nitrogen containing solvents such as NMP, amines, and amides; oxygenates containing compounds such as acids, ketones, esters and aldehydes; paraffins and naphthenes; olefins and the like. Illustrative organic solvents include refinery streams boiling in the range from 100° C. to 500° C., such as diesel fuel or naphtha.

In one embodiment, the mobile kerogen-based product may include carbon disulfide. Hydrogen sulfide, in addition to other sulfur compounds produced from the formation, may be converted to carbon disulfide using known methods. Suitable methods may include oxidation reaction of the sulfur compound to sulfur and/or sulfur dioxides, and by reaction of sulfur and/or sulfur dioxides with carbon and/or a carbon containing compound to form the carbon disulfide formulation.

Extraction

The step of extracting and absorbing the organic acid reaction products into the mobile kerogen-based product fluid, is generally conducted at or near the natural formation temperature. In one such embodiment, the absorbing is conducted at a temperature of less than 200° C.; or less then 150° C.; or less than 100° C.; or even less than 75° C. above the natural formation temperature. In one such embodiment, the absorbing is conducted at a temperature in the range of between 0° C. and 200° C.; or in the range of between 10° C. and 150° C.; or in the range of between 20° C. and 100° C.; or even in the range of between 25° C. and 75° C. In a non-limiting specific example, the absorbing is conducted at a temperature of no greater than 50° C. above the natural formation temperature.

In one embodiment, the absorbing is conducted under conditions in which no added heat is supplied to the formation fluid and/or to the subsurface shale in contact with the formation fluid. In one embodiment, if heat is supplied during the kerogen conversion to meet the above-mention target temperature, it is supplied solely from exothermic chemical processes within the kerogen and/or within the subsurface shale in contact with the kerogen. In one embodiment, the absorbing is conducted at a temperature below pyrolysis temperature.

Generally, the organic acids in the subsurface shale are absorbed into the mobile kerogen-based product at or above formation pressure (i.e., the pressure of the subsurface shale formation in the region that includes the kerogen), so as to maintain or increase the accessibility of the fluids to kerogen in the subsurface shale formation. In one embodiment, the organic acid reaction products are extracted from the kerogen and into the mobile kerogen-based product at a pressure of up to 1000 psig above the formation pressure; or up to 750 psig above the formation pressure; or up to 500 psig above the formation pressure; or even up to 250 psig above the formation pressure. Injection of a gas into the formation may result in a viscosity reduction of some of the hydrocarbon products in the formation.

In one embodiment, a formation fluid is maintained in contact with the kerogen until a target amount of mobile reaction products have been absorbed by the formation fluid, i.e., for a time sufficient to produce a mobile kerogen-based product which contains at least 1 wt. % organic acids; or at least 2 wt. % organic acids; or at least 5 wt. % organic acids. Progress toward reaching the target amount may be monitored, for example, by withdrawing the fluids to the surface for analysis, by analyzing the fluids in the subsurface shale formation, or by analyzing the fluids in a well extending into the formation.

In one embodiment, a formation fluid that is suitable for mobilizing the reaction products has a pH of greater than a target value, e.g., greater than 7, and the formation fluid is maintained in contact with the kerogen for a time during which the pH of the formation fluid remains higher than the target minimum pH value. When the pH approaches or drops below the target minimum, the formation fluid may be removed from the subsurface shale, its alkaline content may be supplemented with alkaline additives, or it may be supplemented with added reactive fluid.

In an embodiment, a liquid solution having a pH of at least 7 and containing at least 0.02 wt. % to 25 wt. % is provided to kerogen in subsurface shale, or to a formation fluid in contact with the kerogen, for converting at least a portion of the kerogen to organic acids. The conversion reactions are conducted in alkaline conditions, with the pH of the formation fluid in the range of at least 7, or in the range from 7 to 9. Additional alkaline materials may be provided to the formation fluid during reaction to maintain the target pH. Suitable alkaline materials include, for example at least one of carbonates, bicarbonates, oxides, and hydroxides of, for example, sodium, potassium, calcium, and magnesium.

The first oxidant is maintained in contact with the kerogen for a time sufficient to cause conversion reactions to occur at a reaction temperature in the range from 0° C. to 200° C. and at formation pressure. In one embodiment, the oxidant is maintained in contact with kerogen for at least 4 hours, or for at least 12 hours. In another embodiment, the formation fluid is maintained in contact with the kerogen for a period in the range from 1 hour to 45 days; in another embodiment from 12 hours to 20 days; in another embodiment from 1 day to 7 days, In one embodiment, the organic acids generated during kerogen conversion are mobilized in the formation fluid having a pH of at least 7, or having a pH of at least 12, or having a pH in the range from 12 to 14. Reaching the desired formation fluid pH may require supplying additional alkaline materials. The mobile kerogen-based product comprising the mobilized organic acids in the formation fluid is recovered for recovery of organic acids and further processing.

In one embodiment, a liquid solution having a pH of at least 7 and containing in the range from 0.1 wt. % to 40 wt. % of a first oxidant is caused to flow through subsurface shale which contains kerogen. The flowing liquid solution causes the formation of organic acids through conversion reactions of the kerogen. Organic acid products are mobilized by the flowing liquid solution. The mobile kerogen-based product comprising the mobilized organic acids in the formation fluid is recovered for recovery of organic acids and further processing.

Figure 3:
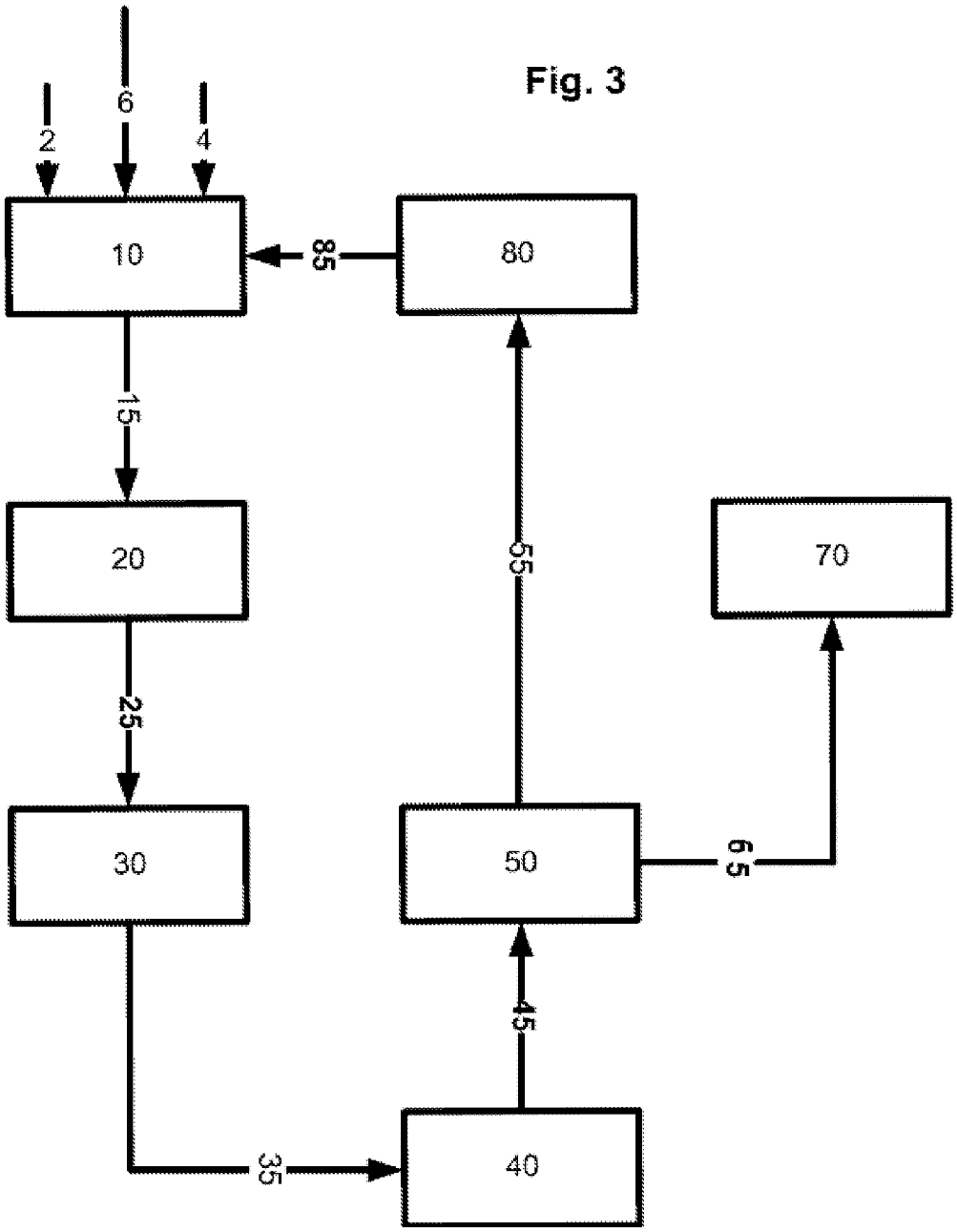
FIG. 3 is a block diagram illustrating an exemplary sequence of steps involving providing a reactive fluid to a subsurface shale formation that contains kerogen, recovering a mobile kerogen-based product from the formation and isolating organic acid products from the mobile kerogen-based product.

In an exemplary process illustrated in FIG. 3, a reactive fluid is prepared in a preparation step 10 by mixing a first oxidant 2 with a carrier fluid 4, which may be aqueous or organic. Mixing devices for mixing the first oxidant with the carrier fluid to make the reactive fluid are well known. In one embodiment, the first oxidant that is used is effective for reacting with kerogen in an alkaline medium; under these conditions the fluid may optionally be mixed with an alkaline material 6 to result in a fluid having a pH of at least 7.

The reactive fluid 15 is passed to the kerogen in the subsurface shale formation in step 20 via a first (e.g., injection) well that has been drilled to penetrate the subsurface formation to provide access to the kerogen within the formation. The reactive fluid is induced to migrate from the injection well to the kerogen using electrokinetic induced migration. The reactive fluid combines with a fluid already present to form a formation fluid 25, in contact with the kerogen. In one embodiment, the subsurface shale formation has been fractured to enhance the permeability of the shale to the first oxidant and to increase the accessibility of the kerogen component to this fluid. In step 30 the first oxidant reacts with the kerogen to produce a mobile kerogen-based product 35, which is produced to the production well in step 40, using electrokinetic induced migration.

The mobile kerogen-based product 45 produced at the surface is treated in step 50 for isolation and recovery of the organic acids and other mobile hydrocarbons 75. In one embodiment, at least a portion of the reaction products recovered from the kerogen conversion is absorbed by naturally occurring alkaline enriched water that is present in the subsurface shale. In the illustrative process shown in FIG. 3, the organic acids 75 isolated in step 50 are subjected to further processing in step 70. In an embodiment of the illustrative process, an organic acid lean fluid 55 that is produced from the isolation step 50 is further treated in step 80 for recycle 85 to the subsurface shale formation.

Figure 4:
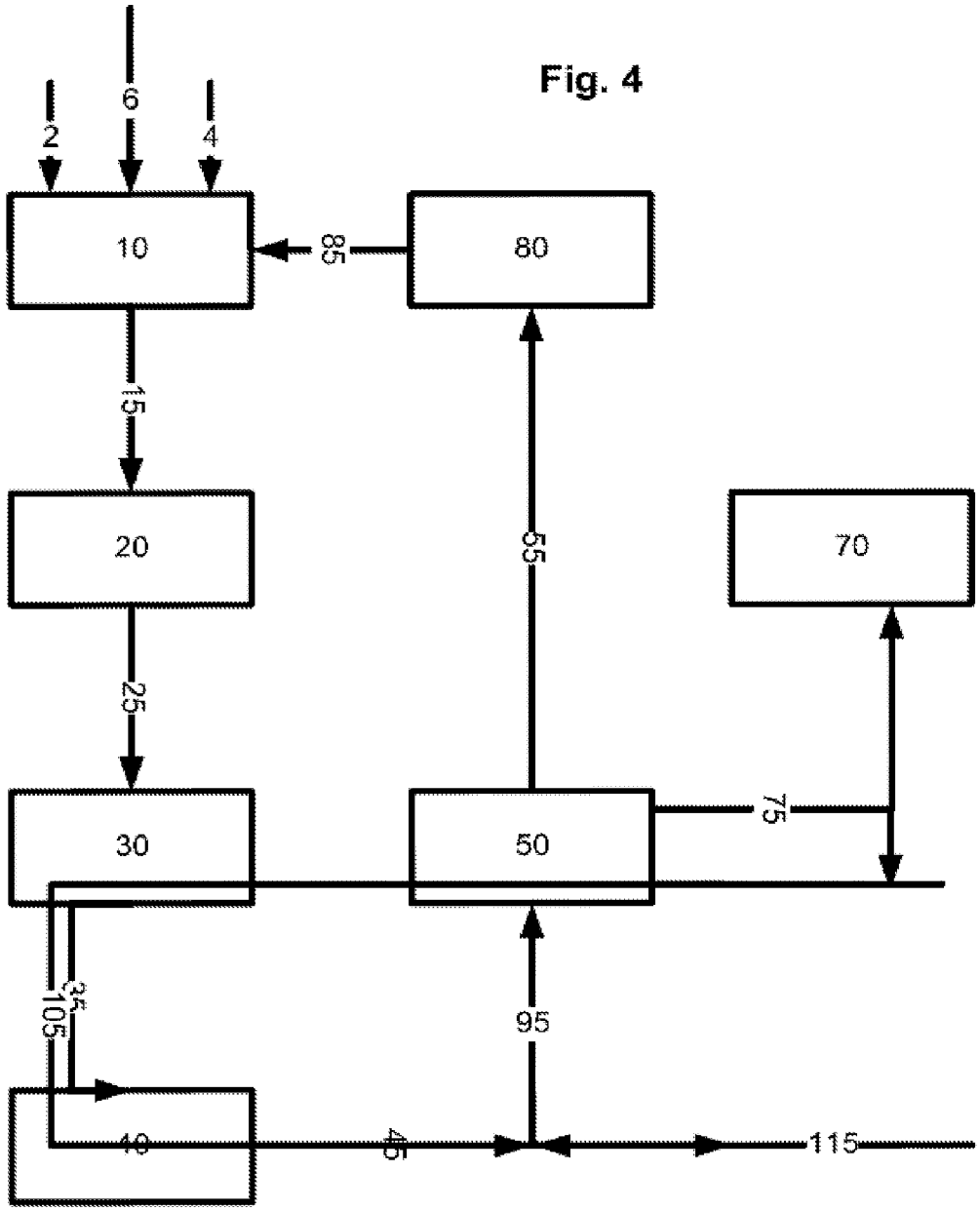
FIG. 4 is a block diagram illustrating the added step of passing an organic extractant to the mobile kerogen-based product for extracting at least a portion of the organic acids contained in the mobile kerogen-based product.

In an exemplary process illustrated in FIG. 4, and with further reference to the descriptions above relating to FIG. 3, in step 30 the first oxidant reacts with the kerogen to produce a mobile kerogen-based product 35, which is produced to the production well in step 40, using electrokinetic induced migration.

Further in FIG. 4, a mobile kerogen-based product 35 is produced to the surface in step 40. The mobile kerogen-based product 45 produced at the surface is combined with an organic extractant 115 and the combination stream 95 is treated in step 50 for isolation and recovery of the organic acids and other mobile hydrocarbons 65. The organic acids 65 isolated in step 50 are subjected to further processing in step 70. In an embodiment of the illustrative process, an organic acid lean fluid 55 that is produced from the isolation step 50 is further treated in step 80 for recycle 85 to the subsurface shale formation. A portion of acid lean extractant 115 from step 50 is recycled and combined with organic extractant 75 (step not shown).

Figure 5:
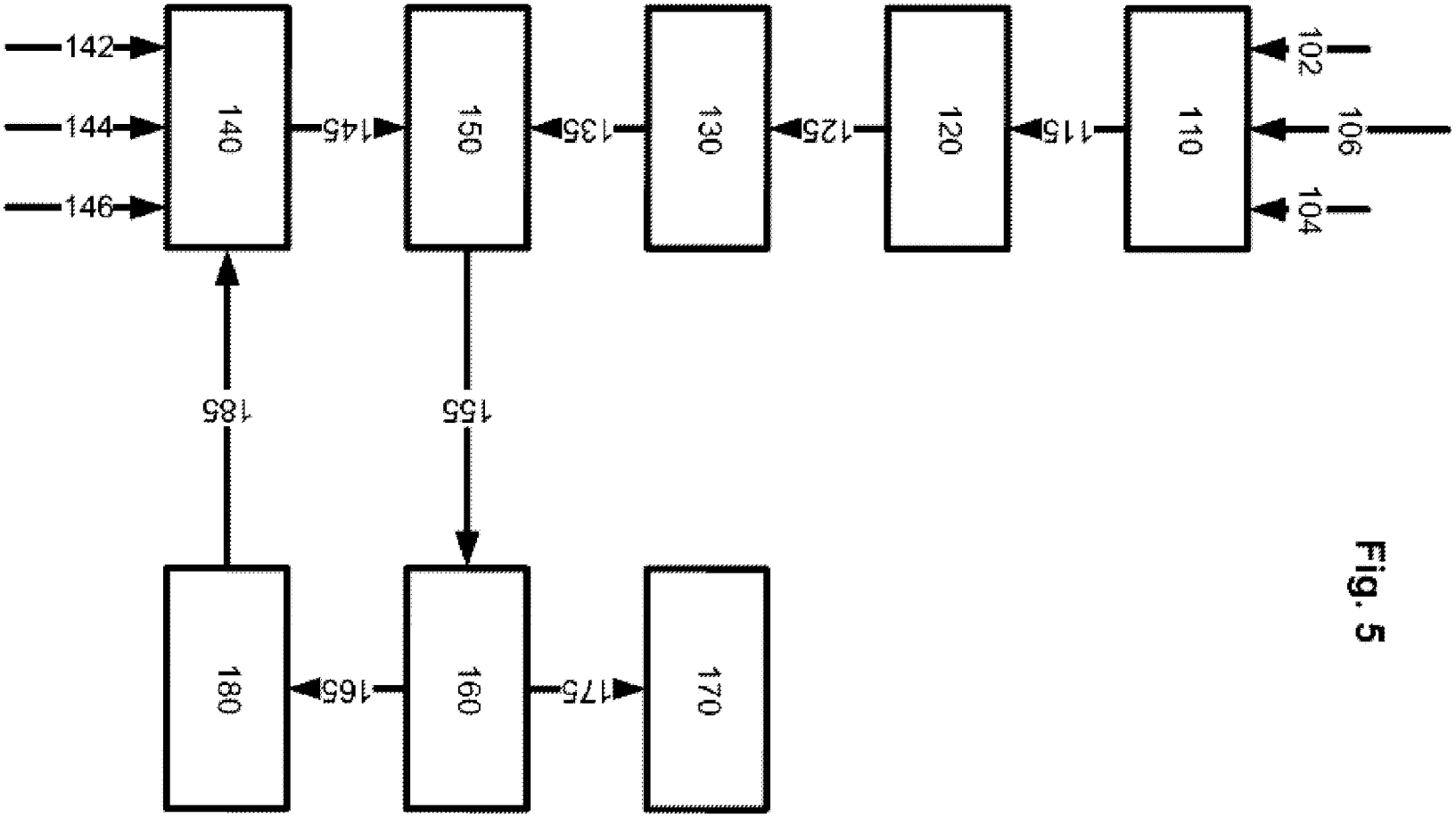
FIG. 5 is a block diagram illustrating an exemplary sequence of steps involving providing a reactive fluid to a subsurface shale formation that contains kerogen, further providing an extractive fluid for mobilizing organic acids that are generated from kerogen reactions, recovering a mobile kerogen-based product from the formation and isolating organic acid products from the mobile kerogen-based product.

In an exemplary process illustrated in FIG. 5, a reactive fluid 115 is prepared in a preparation step 110 by mixing a first oxidant 102 with a carrier fluid 104, which may be aqueous or organic. Mixing devices for mixing the first oxidant with the carrier fluid to make the reactive fluid are well known. In one embodiment, the first oxidant that is used is effective for reacting with kerogen in an alkaline medium; under these conditions the fluid may optionally be mixed with an alkaline material 106 to result in a fluid having a pH of at least 7.

The reactive fluid mixture 115 is passed to the kerogen in the subsurface shale formation in step 120 via a first (e.g., injection) well that has been drilled to penetrate the subsurface formation to provide access to the kerogen within the formation. The reactive fluid is induced to migrate from the injection well to the kerogen using electrokinetic induced migration. The reactive fluid combines with a fluid already present to form a formation fluid 125, in contact with the kerogen. In one embodiment, the subsurface shale formation has been fractured to enhance the permeability of the shale to the formation fluid and to increase the accessibility of the kerogen component to this fluid. In step 130, the first oxidant reacts with the kerogen to form organic acids 135.

An extractive fluid 145 is prepared in preparation step 140 by mixing an alkaline material 142 with an aqueous carrier fluid 144 and optionally with a surfactant 146. The extractive fluid 145 is combined into the formation fluid in step 150 for mobilizing the organic acids and to form the mobile kerogen-based product 155, which is recovered, using electrokinetic induced migration from the kerogen to a production well. The mobile kerogen-based product 155 is treated in 160 to isolate organic acids 175, which may be further processed in 170.

Isolating the organic acids further produces an organic acid lean fluid 165, containing a reduced amount of organic acids. This fluid is prepared for return to the formation as a recycle fluid 185. Prior to recycling, the organic acid lean fluid may be conditioned in step 180 for recycling to the formation. Typical conditioning steps include, for example, removing inorganic salts, removing at least a portion of the remaining organic acids, including $C_1$ to $C_{10}$ organic acids, and removing other organic material from the fluid.

In one embodiment, the process for extracting a kerogen-based product includes causing the mobile kerogen-based product to flow through the subsurface shale formation and to a second (e.g., production) well that has been drilled to penetrate the subsurface formation to withdraw fluids from the formation. The formation fluid in contact with the kerogen causes some of the kerogen to react and form mobile reaction products, which are recovered from the subsurface shale to surface facilities for isolation and recovery of the mobile reaction products. In one embodiment, at least a portion of the mobile reaction products are absorbed by the formation fluid and the resulting mobile kerogen-based product is recovered from the subsurface shale formation.

In one embodiment, one or more electrodes are placed within the kerogen rich zone of the subsurface shale formation, in communication with the production well such that the one or more electrodes act as either an anode or a cathode. Similarly, one or more electrodes are placed in communication with production well such that the electrically charged production well acts as an opposing cathode or anode to injection well. The respective charges create an electric current in the reservoir fluids contained within kerogen rich zone of subsurface shale formation 10, which induces electrokinetic migration of the mobile kerogen-based product such that the product is urged to the production well for recovery. One skilled in the art will appreciate that additional electrodes can be placed within the subsurface shale formation, such that an electric field is created that is capable of directing the mobile kerogen-based product from a plurality of areas of within subsurface shale formation toward one or more production wells. In some embodiments, the electrodes are positioned directly within the kerogen rich zone. In some embodiments, the electrodes are positioned at locations above or below kerogen rich zone such as within rock layers adjacent to kerogen rich zone.

A variation (i.e., alternate embodiment) on the above-described process is the application of some or part of such above-described methods to alternative sources, i.e., low-permeability hydrocarbon-bearing (e.g., oil and gas) formations, in situ coal, in situ heavy oil, in situ oil sands, and the like. General applicability of at least some of the above-described invention embodiments to any hydrocarbon-bearing formation exists. Surface processing applications may include upgrading of oil shale, coal, heavy oil, oil sands, and other conventional oils with asphaltenes, sulfur, nitrogen, etc.

EXAMPLES

Example 1

The advantages of electrokinetic-induced migration over traditional hydraulic delivery is illustrated in the following experiment. A thin glass tank having a width of about 4 cm was constructed to simulate a two-dimensional flow field through a heterogeneous porous media. House-brick sized pieces of clay, which represent low permeability features, were emplaced within a zone of contiguous glass beads. The glass beads represent the high permeability zones of channeled flow. The tank was saturated with water and a flow field was established across the apparatus by fixing the hydraulic head (water elevation) at different heights on either side of the tank. Potassium permanganate was introduced into one side of the tank and allowed to flow through the apparatus. The potassium permanganate was substantially distributed within the glass beads after two hours. However, essentially no infiltration into the clay bricks occurred, indicating that the potassium permanganate bypassed the low permeability zones. This experiment was repeated, however, an anode and cathode were placed at either end of the tank after the potassium permanganate had flowed through the apparatus for two hours. A low voltage direct current of approximately 10 volts per meter (V/m) was applied between the anode and cathode for 20 minutes. The clay blocks were dissected and showed that the potassium permanganate fully penetrated the clay bricks.

Example 2

This example illustrates the effectiveness of potassium permanganate for producing high molecular weight organic acids in reactions with kerogen.

Kerogen was separated from a sample of oil shale that contained kerogen. The separated kerogen was largely organic matter, with a small amount of inorganic matter remaining from the inorganic substrate in which the kerogen originated. For this example, 2.50 grams of kerogen (organic matter basis) was combined with a solution containing 0.5 g $KMnO_4$ in 100 ml of 1% KOH solution. The kerogen/$KMnO_4$ mixture was stirred at 75° C. until the solution had lost its color, with no visual evidence of the purple permanganate color remaining In general, this reaction took several hours, and up to 12 hours in some cases. The kerogen was then allowed to settle, and was separated from the solution. The kerogen was then rinsed with two 75 ml aliquots of 1% KOH solution. The two rinse solutions were set aside. The rinsed kerogen was then contacted with another aliquot of $KMnO_4$ solution, and the oxidation and washing steps were repeated. After five successive $KMnO_4$ treatments, the kerogen was washed with oxalic acid solution at low pH to dissolve $MnO_2$ which was deposited on the kerogen surface. The kerogen was then rinsed before the next $KMnO_4$ treatment step. At the end of 17 $KMnO_4$ treatments, the kerogen was effectively consumed, and the permanganate color of the solution no longer disappeared. All of the 1% KOH rinse solutions collected from each treatment step were combined and acidified to pH 2.0. High molecular weight acids in the acidified solution precipitated from solution and were recovered. Low molecular weight acids in the solution were extracted with methyl t-butyl ether and recovered by removing the ether solvent.

Figure 6:
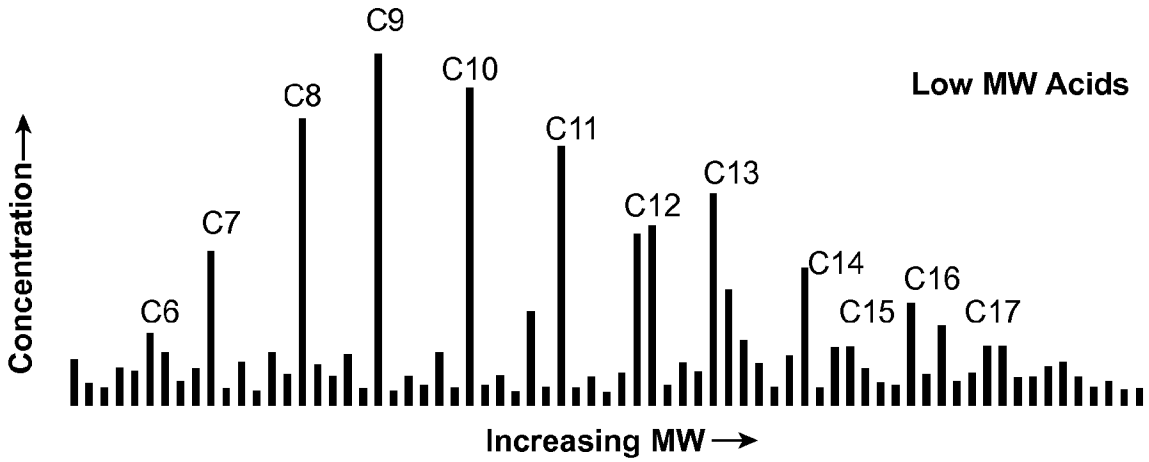
FIG. 6 illustrates carbon chain-size distribution of low molecular weight acids in kerogen permanganate oxidation products determined by gas chromatography/mass spectrometry.

FIG. 6 illustrates the gas chromatographic separation of the low molecular weight acids. A high proportion of the low molecular weight (i.e., $C_{35}$−) organic acids are in the $C_8$ to $C_{12}$ range. In particular, FIG. 6 shows carbon chain-size distribution of low molecular weight organic acids (di-carboxylic acids and mono-carboxylic acids) in kerogen permanganate oxidation products determined by gas chromatography—mass spectrometry (GCMS) of their silyl derivatives. The high-pH aqueous reaction product solution was adjusted to ~pH 2 and extracted with methyl t-butyl ether solvent to yield low molecular weight organic acids upon solvent removal. GCMS analysis showed these organic acids contain primarily straight (un-branched) alkyl chains. Hydroprocessing of this low molecular weight organic acids product to remove oxygen and other heteroatoms would provide the alkane mixture shown in the figure, where the number of carbon atoms in each of the major, straight-chain product peaks is labeled. The carbon number distribution of products range from ~$C_6$ to ~$C_{17}$ (with a maximum at $C_9$), covering the highly desirable gasoline, jet, and diesel transportation fuel hydrocarbon molecular weight range.

Figure 7:
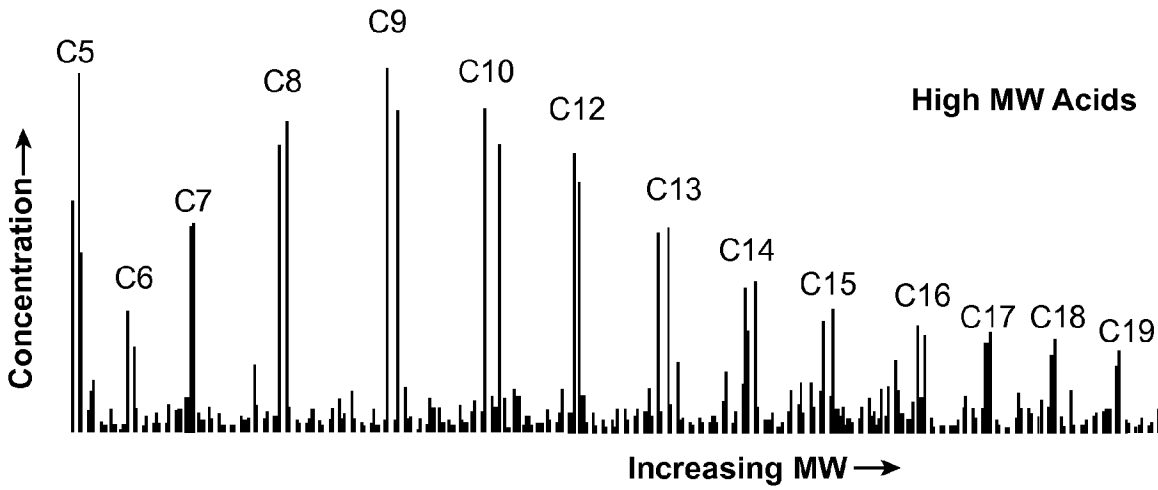
FIG. 7 illustrates carbon chain-size distribution of hydrocarbon products formed by pyrolysis of high molecular weight organic acids in kerogen permanganate oxidation products determined by pyrolysis gas chromatography/mass spectrometry.

The high molecular weight (i.e., $C_{35}$+) organic acids were passed through a pyrolysis gas chromatograph, which thermally pyrolyzed the acids. FIG. 7 is a gas chromatographic trace of the pyrolyzed acids. In particular, FIG. 7 shows carbon chain-size distribution of hydrocarbon products formed by pyrolysis of high molecular weight organic acids in kerogen permanganate oxidation products determined by pyrolysis gas chromatography—mass spectrometry (pyrolysis-GCMS). The high-pH aqueous reaction product solution was adjusted to ~pH 2 resulting in the precipitation of high molecular weight organic acids which were collected, washed with deionized water, and dried under vacuum. Pyrolysis-GCMS analysis showed these high molecular weight organic acids to yield primarily straight (un-branched) alkanes and alkenes upon heating to 500° C. in inert atmosphere. The number of carbon atoms in each of the major, straight-chain product peaks is labeled in the figure—each carbon number labels two peaks, consisting of an alkane and alkene pair, typical of pyrolysis/retort products. Hydroprocessing of the pyrolysis (retort) products shown in the figure, to remove alkenes and heteroatoms, would provide an alkane mixture with a carbon number distribution ranging from ~$C_5$ to ~$C_{31}$ (with a maximum at $C_9$), covering the highly desirable gasoline, jet, and diesel fuel hydrocarbon molecular weight range, with a small proportion of product in the fuel oil and lube oil hydrocarbon molecular weight range.

It is interesting to note that the profile of the pyrolyzed acids is very similar to the profile of the low molecular weight acids. In particular, a high proportion of the pyrolyzed organic acids are also in the $C_8$ to $C_{12}$ range.

Various modifications and alterations of this invention will become apparent to those skilled in the art without departing from the scope and spirit of the invention. Other objects and advantages will become apparent to those skilled in the art from a review of the preceding description.

What is claimed is:

1. A process for extracting a kerogen-based product from a subsurface shale formation comprising a kerogen rich zone, the process comprising:

providing an injection well and a production well that extend into a subsurface shale formation and are in fluid communication therewith;

injecting an oxidant into the subsurface shale formation through the injection well;

generating an electric field through at least a portion of the subsurface shale formation to induce electrokinetic migration of the oxidant, wherein the electric field is generated by placing one or more electrodes in communication with the injection well for creating a direct current having a voltage of less than about 50 volts per meter (V/m);

contacting the kerogen in the subsurface shale formation with the oxidant at a temperature in the range of between 0° C. and 200° C. to form organic acids, wherein no external heating is provided for the contact; and mobilizing at least a portion of the organic acids from the subsurface shale formation through the production well to produce a mobile kerogen-based product.

2. The process according to claim 1, wherein the oxidant is injected into the subsurface shale formation combined with an aqueous carrier fluid.

3. The process according to claim 2, wherein the carrier fluid contains in the range from 0.1 wt. % to 40 wt. % of the oxidant.

4. The process according to claim 2, wherein the carrier fluid has a pH in the range from 7 to 14.

5. The process according to claim 1, wherein the oxidant is a permanganate oxidant.

6. The process according to claim 5, wherein the permanganate oxidant is selected from the group consisting of ammonium permanganate, $NH_4MnO_4$; calcium permanganate, $Ca(MnO_4)_2$; potassium permanganate, $KMnO_4$; and sodium permanganate, $NaMnO_4$.

7. The process according to claim 2, wherein the carrier fluid further comprises a surfactant.

8. The process according to claim 1, further comprising contacting the kerogen in the subsurface shale formation with the oxidant at a pH in the range from 7 to 14 to form organic acids.

9. The process according to claim 8, further comprising maintaining the pH in the range from 7 to 14 by supplying an alkaline material selected from the group consisting of a carbonate, a bicarbonate, an oxide and a hydroxide to the kerogen.

10. The process according to claim 9, further comprising contacting the kerogen in the subsurface shale formation with the oxidant at a pH in the range from 7 to 9.

11. The process according to claim 1, further comprising providing a reactive fluid to the kerogen, the reactive fluid comprising from 0.1 wt. % to 40 wt. % of the oxidant in a carrier fluid selected from the group consisting of an aqueous fluid, an ethanol fluid or combinations thereof.

12. The process according to claim 11, wherein the reactive fluid further comprises a sufficient amount of an alkaline material to yield a reactive fluid having a pH in a range from 7 to 9.

13. The process according to claim 11, wherein the reactive fluid further comprises in the range from 2 wt. % to 10 wt. % of a surfactant.

14. The process according to claim 13, wherein the surfactant comprises organic acids.

15. The process according to claim 11, further comprising generating an electric field through at least a portion of the subsurface shale formation to induce electrokinetic migration of the reactive fluid.

16. The process according to claim 1, wherein the electric field is generated by emitting a direct current between a pair of electrodes having opposite charges and being spaced apart from one another within the kerogen rich zone.

17. The process according to claim 1, wherein the electric field is generated by emitting a direct current between a first electrode coupled to the injection well and a second electrode within the kerogen rich zone.

18. The process according to claim 1, wherein the electric field is generated by emitting a direct current having a voltage of less than about 20 volts per meter between a pair of electrodes.

19. A process for extracting a kerogen-based product from a subsurface shale formation comprising a kerogen rich zone, the process comprising:

providing an injection well and a production well that extend into a subsurface shale formation and are in fluid communication therewith;

injecting an oxidant into the subsurface shale formation through the injection well;

contacting the kerogen in the subsurface shale formation with the oxidant at a temperature in the range of between 0° C. and 200° C. to form organic acids, wherein no external heating is provided for the contact; and mobilizing at least a portion of the organic acids from the subsurface shale formation through the production well to produce a mobile kerogen-based product; and generating an electric field through at least a portion of the subsurface shale formation to induce electrokinetic migration of the mobile kerogen-based product to a production well, wherein the electric field is generated by placing one or more electrodes in communication with the injection well for creating a direct current having a voltage of less than about 50 volts per meter (V/m).

20. The process according to claim 19, wherein the electric field is generated by emitting a direct current between a pair of electrodes having opposite charges and being spaced apart from one another within the kerogen rich zone.

21. The process according to claim 19, wherein the electric field is generated by emitting a direct current between a pair of electrodes with the first electrode coupled to the production well and a second electrode within the kerogen rich zone.

22. The process according to claim 21, wherein the direct current has a voltage of less than about 20 volts per meter.

23. The process according to claim 21, wherein the direct current is periodically pulsed.

24. The process according to claim 21, wherein polarity of the pair of electrodes is periodically reversed.

25. A process for enhancing hydrocarbon recovery in subsurface shale formations, the method comprising:

providing an injection well and a production well that extend into a kerogen rich zone of a subsurface shale formation and are in fluid communication therewith;

providing a plurality of electrodes interspersed within the kerogen rich zone of a subsurface shale formation for creating a direct current having a voltage of less than about 50 volts per meter (V/m) through at least a portion of the subsurface shale formation;

injecting an oxidant into the kerogen rich zone through the injection well for the kerogen to be in contact with the oxidant at a temperature in the range of between 0° C. and 200° C., wherein no external heating is provided for the contact;

emitting a direct current between the plurality of electrodes to induce electrokinetic migration of the oxidant;

recovering hydrocarbons from the kerogen rich zone of the subsurface shale formation through the production well.

26. The process according to claim 25, further comprising:

providing a reactive fluid to the kerogen rich zone and adjusting the direct current emitted between one or more of the plurality of electrodes such that the reactive fluid migrates to unswept areas of the kerogen rich zone.

27. The process according to claim 25, further comprising injecting a catalyst or catalyst precursor into the subsurface shale formation for the direct current through at least a portion of the subsurface shale formation-to induce electrokinetic migration of the catalyst or catalyst precursor.

28. The process according to claim 27, further comprising injecting a reactive fluid comprising the catalyst or catalyst precursor.

29. The process according to claim 27, wherein the catalyst or catalyst precursor is an ionic metal, a complexed metal or an encapsulated metal.

30. The process according to claim 27, wherein the catalyst or catalyst precursor is a metal selected from the group consisting of magnesium, calcium, vanadium, chromium, molybdenum, manganese, iron, cobalt, nickel, palladium, platinum, copper, zinc, aluminum, and silicon.

31. The process according to claim 27, wherein the catalyst or catalyst precursor is an ionic metal selected from the group consisting of $Ni^{2+}$, $Ni^{1+}$, $Mo^{2+}$, $Cu^{2+}$,$Cu^{3+}$, $Fe^{2+}$, $Fe^{3+}$.

32. The process according to claim 27, wherein the catalyst or catalyst precursor is induced to be deposited on the kerogen.

33. A process for extracting a kerogen-based product from a subsurface shale formation comprising a kerogen rich zone, the process comprising:

providing an injection well and a production well that extend into a subsurface shale formation and are in fluid communication therewith;

injecting a catalyst or catalyst precursor into the subsurface shale formation through the injection well;

generating an electric field having a voltage of less than about 50 volts per meter (V/m) through at least a portion of the subsurface shale formation to induce electrokinetic migration of the catalyst or catalyst precursor;

contacting the kerogen in the subsurface shale formation with the catalyst precursor at a temperature in the range of between 0° C. and 200° C. to form kerogen conversion products, wherein no external heating is provided for the contact; and mobilizing at least a portion of the kerogen conversion products through the production well to produce a mobile kerogen-based product.

34. A process for extracting a kerogen-based product from a subsurface shale formation comprising a kerogen rich zone, the process comprising:

providing an injection well and a production well that extend into a subsurface shale formation and are in fluid communication therewith;

injecting a catalyst or catalyst precursor into the subsurface shale formation through the injection well;

contacting the kerogen in the subsurface shale formation with the catalyst or catalyst precursor at a temperature in the range of between 0° C. and 200° C. to form kerogen conversion products, wherein no external heating is provided for the contact;

mobilizing at least a portion of the kerogen conversion products from the subsurface shale formation through the production well to produce a mobile kerogen-based product; and generating an electric field through at least a portion of the subsurface shale formation to induce electrokinetic migration of the mobile kerogen-based product to the production well wherein the electric field is generated by placing one or more electrodes in communication with the injection well for creating a direct current having a voltage of less than about 50 volts per meter (V/m).

* * * * *